US010483065B2

(12) United States Patent
Oh

(10) Patent No.: US 10,483,065 B2
(45) Date of Patent: Nov. 19, 2019

(54) MOLDED-CASE CIRCUIT BREAKER FOR DC

(71) Applicant: LSIS CO., LTD., Anyang-si, Gyeonggi-do (KR)

(72) Inventor: Kihwan Oh, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 0 days.

(21) Appl. No.: 15/857,001

(22) Filed: Dec. 28, 2017

(65) Prior Publication Data

US 2018/0190462 A1 Jul. 5, 2018

(30) Foreign Application Priority Data

Dec. 30, 2016 (KR) ..... 10-2016-0184409

(51) Int. Cl.
*H01H 71/08* (2006.01)
*H01H 71/02* (2006.01)
*H01H 71/12* (2006.01)

(52) U.S. Cl.
CPC ..... *H01H 71/082* (2013.01); *H01H 71/02* (2013.01); *H01H 71/12* (2013.01); *H01H 2235/01* (2013.01)

(58) Field of Classification Search
CPC ..... H01H 71/082; H01H 71/12; H01H 71/02; H01H 71/164; H01H 71/1045; H01H 33/596; H01H 9/40; H01H 2235/01; H01H 73/48; H01H 9/0072; H01H 71/40; H01H 2071/1036
See application file for complete search history.

(56) References Cited

U.S. PATENT DOCUMENTS 4,020,400 A * 4/1977 Hawkes, Jr. ..... H02B 1/056 200/293
8,115,124 B2 2/2012 Maruyama
8,757,697 B2 6/2014 Held
(Continued)

FOREIGN PATENT DOCUMENTS

CN 201503830 U 6/2010
CN 102280322 A 12/2011
(Continued)

OTHER PUBLICATIONS

European Search Report for related European Application No. 17191831.1; report dated Apr. 16, 2018 (8 pages).
(Continued)

*Primary Examiner* — Edwin A. Leon
*Assistant Examiner* — Lheiren Mae A Caroc
(74) *Attorney, Agent, or Firm* — K&L Gates LLP

(57) ABSTRACT

The present invention relates to a molded-case circuit breaker for direct current (DC), and more particularly, to a molded-case circuit breaker for DC that contains an internal connecting conductor connecting adjacent terminals to improve insulation performance and assemblability and reduce occupied space. There is provided a molded-case circuit breaker for DC that contains a plurality of interruption units within an outer casing, the DC circuit breaker including a two-unit connecting heater that connects fixed contacts of adjacent interruption units, the two-unit connecting heater being placed within the outer casing.

11 Claims, 28 Drawing Sheets

(56) References Cited

U.S. PATENT DOCUMENTS

| | | | | |
|---|---|---|---|---|
| 8,830,025 | B2 | 9/2014 | Nakano | |
| 2004/0074748 | A1 | 4/2004 | Azzola | |
| 2011/0297518 | A1* | 12/2011 | Baujan | H01H 71/7409 200/17 R |
| 2016/0079024 | A1 | 3/2016 | Nereau | |
| 2018/0233314 | A1* | 8/2018 | Oh | H01H 9/32 |

FOREIGN PATENT DOCUMENTS

| | | | |
|---|---|---|---|
| CN | 202268314 | U | 6/2012 |
| CN | 202405210 | U | 8/2012 |
| CN | 202957205 | U | 5/2013 |
| CN | 203312208 | U | 11/2013 |
| CN | 103871792 | A | 6/2014 |
| CN | 205028863 | U | 2/2016 |
| CN | 105428168 | A | 3/2016 |
| DE | 7602660 | | 7/1976 |
| JP | H01122247 | U | 8/1989 |
| JP | H0547285 | A | 2/1993 |
| JP | 3147181 | U | 12/2008 |
| JP | 4366812 | B2 | 11/2009 |
| JP | 5276534 | B2 | 8/2013 |
| JP | 2015220769 | A | 12/2015 |
| JP | 2016510161 | A | 4/2016 |
| KR | 101252409 | B1 | 4/2013 |
| KR | 2020160002213 | | 6/2016 |

OTHER PUBLICATIONS

Korean Office Action for related Korean Application No. 10-2016-0184409; action dated Jan. 30, 2018; (6 pages).

Japanese Notice of Allowance for related Japanese Application No. 2017-249014; (Action dated Dec. 4, 2018; (1 page).

Chinese Office Action for related Chinese Application No. 201711351277.9; action dated Dec. 3, 2018; (11 pages).

Chinese Office Action for related Chinese Application No. 201711351277.9; action dated Jun. 12, 2019; (12 pages).

* cited by examiner

MOLDED-CASE CIRCUIT BREAKER FOR DC

CROSS-REFERENCE TO RELATED APPLICATION

Pursuant to 35 U.S.C. § 119(a), this application claims the benefit of earlier filing date and right of priority to Korean Application No. 10-2016-0184409, filed on Dec. 30, 2016, the contents of which are incorporated by reference herein in its entirety.

BACKGROUND OF THE INVENTION

1. Field of the Invention

The present invention relates to a molded-case circuit breaker for direct current (DC), and more particularly, to a molded-case circuit breaker for DC that contains an internal connecting conductor connecting adjacent terminals to improve insulation performance and assemblability and reduce occupied space.

2. Description of the Conventional Art

In general, a molded-case circuit breaker (MCCB) is an electrical device that protects a circuit and a load by automatically interrupting the circuit when there is an electrical overload or short circuit. The circuit breaker includes a terminal portion provided on the front and rear and forming a circuit connection, a mechanism divided into a fixed contact and a movable contact and mechanically opening and closing a circuit, a trip portion detecting an over-current or short-circuit current in the circuit and causing the mechanism to trip, and an extinguisher for extinguishing an arc produced when interrupting a fault current.

Such a circuit breaker is generally used for alternating current (AC) and may be converted for use in DC applications. In order to convert a circuit breaker for AC to one for DC, in the conventional art, connecting conductors (also referred to as "externally connected conductors or common bus bars") may be added to the terminal portion of the existing circuit breaker to configure and use circuits in series.

A molded-case circuit breaker for DC according to the conventional art will now be described. A molded-case circuit breaker including an even number of poles (units) and a molded-case circuit breaker including an odd number of poles (units) will be discussed separately.

First of all, a molded-case circuit breaker with an even number of poles (e.g., four poles) will be described.

FIG. 1 depicts a perspective view of a four-pole (four-unit) molded-case circuit breaker for AC according to the conventional art. FIG. 2 depicts a perspective view of a four-unit molded-case circuit breaker for DC according to the conventional art. FIG. 3 is an internal perspective view of the circuit breaker of FIG. 2, from which the cover is partially cut away and the externally connected conductors are separated. FIG. 4 is a perspective view of a trip portion shown in FIG. 3. FIG. 5 is an exploded perspective view of tripping mechanisms, terminals, and an externally connected conductor shown in FIG. 4. FIG. 6 depicts a wiring diagram of the four-unit molded-case circuit breaker for DC according to the conventional art.

As is generally known, a molded-case circuit breaker for AC according to the conventional art includes a switch mechanism 3, a contact portion 7, a trip portion 5, and a terminal portion 2*a*, 2*b*, 2*c*, 2*d*, 2*e*, 2*f*, 2*g*, and 2*h* which is placed within an outer casing consisting of a case 1*a* and a cover 1*b*. Other internal components than the switch mechanism 3 are provided for each phase (unit). That is, in the four-unit circuit breaker, these components are provided for each of four phases: R phase, S phase, T phase, and N phase. The terminal portion 2*a*, 2*b*, 2*c*, 2*d*, 2*e*, 2*f*, 2*g*, and 2*h* includes a front terminal portion 2*a*, 2*b*, 2*c*, and 2*d* on the front of the circuit breaker and a rear terminal portion 2*e*, 2*f*, 2*g*, and 2*h* on the rear of the circuit breaker. For better comprehension, each unit will be described with respect to the R phase, S phase, T phase, and N phase of a circuit breaker for AC). A power source and a load may be connected to the rear terminal portion 2*e*, 2*f*, 2*g*, and 2*h*.

In order to use the circuit breaker for DC applications, externally connected conductors 4*a* and 4*b* are attached to the rear terminal portion 2*e*, 2*f*, 2*g*, and 2*h* and the front terminal portion 2*a*, 2*b*, 2*c*, and 2*d*. FIG. 3 shows an example of a molded-case circuit breaker for DC to which the externally connected conductors are connected The front terminal portion 2*a*, 2*b*, 2*c*, and 2*d* has a plurality of U-shaped externally connected conductors that connect a pair of adjacent terminals. In this example, an N phase front terminal 2*a* and an R phase front terminal 2*b* are connected by a U-shaped externally connected conductor 4*a*, and an S phase front terminal 2*c* and a T phase front terminal 2*d* are connected by a U-shaped externally connected conductor 4*b*. In the rear terminal portion 2*e*, 2*f*, 2*g*, and 2*h*, an I-shaped externally connected conductor 4*b* may be connected to each phase. In the terminal portion 2*e*, 2*f*, 2*g*, and 2*h* on the power source side and the front terminal portion 2*a*, 2*b*, 2*c*, and 2*d*, an insulation barrier 6 may be mounted between each of the externally connected conductors 4*a* and 4*b* in order to ensure insulation.

Referring mainly to FIGS. 3 to 5, the trip portion 5 includes a crossbar 5*b* mounted across a trip portion case 5*a*, a heater 5*d* connected to a fixed contact (not shown) of the contact portion 7, bimetal 5*c* that is bent by heat generated from the heater 5*d* in case of an over-current in a circuit and that presses a contact region 5*b*1 of the crossbar 5*b* to rotate the crossbar 5*b*, a magnet 5*e* that has a magnetic force, an armateur 5*f* that is magnetized in case of a sudden over-current ad rotates in the direction of the magnet 5*e*, and a trip spring 5*g*. A tripping mechanism including the heater 5*d*, bimetal 5*c*, magnet 5*e*, amarteur 5*f*, and trip spring 5*g* is provided for each phase. Each terminal of the front terminal portion 2*a*, 2*b*, 2*c*, and 2*d* may be connected to the heater 5*d*. Each terminal of the front terminal portion 2*a*, 2*b*, 2*c*, and 2*d* may be formed integrally with the heater 5*d*.

FIG. 5 depicts a pair of tripping mechanisms, a pair of terminals, and a U-shaped externally connected conductor 4*a* connecting the pair of terminals. The U-shaped externally connected conductor 4*a* serves to connect a pair of adjacent terminals. In this case, the U-shaped externally connected conductor 4*a* is exposed out of the outer casing 1*a* and 1*b*.

FIG. 6 shows a wiring diagram of the molded-case circuit breaker for DC according to the conventional art. The U-shaped externally connected conductor 4*a* is attached to the front terminal portion 2*a*, 2*b*, 2*c*, and 2*d* in such a manner that a pair of adjacent terminals are connected. A load 8 and a power source 9*a* and 9*b* are connected to the rear terminal portion 2*e*, 2*f*, 2*g*, and 2*h*.

Next, a molded-case circuit breaker with an odd number of poles (e.g., three poles) will be described.

FIGS. 7 and 8 depict a perspective view and internal structure diagram of a three-unit molded-case circuit breaker for DC according to the conventional art. FIG. 9 depicts a trip portion and a terminal. FIG. 10 depicts a wiring diagram of the three-unit molded-case circuit breaker for DC according to the conventional art.

In the three-phase (three-unit) circuit breaker, three phases: R phase, S phase, T phase are provided. I-shaped externally connected conductors 4*b* are provided at the T-phase rear terminals 2*f*, 2*g*, and 2*h* (on the power source side) and the R-phase front terminal 2*b* (on the load side). A U-shaped externally connected conductor 4*a* is provided at the S-phase and T-phase front terminals 2*c* and 2*d* to connect them together. The I-shaped externally connected conductors 4*b* are optionally mounted in order to ensure consistency with the externally connected conductor 4*a* in terms of the arrangement of terminals or the amount of current carried. If the I-shaped externally connected conductors 4*b* are omitted, the power source or load may be connected directly to the terminal portion 2*b*, 2*c*, 2*d*, 2*f*, 2*g*, and 2*h*.

When the above circuit breaker with an odd number of poles is connected in series, the input and output are not easily distinguishable in terms of position. That is, both poles 9*a* and 9*b* of the power source and one pole, i.e., the minus pole 8*b* in this case, of the load are aligned in the same direction. In other words, both poles 8*a* and 8*b* of the load are arranged respectively on the front and rear of the outer casing 1. Thus, an externally connected conductor, i.e., a connecting conductor 4*c*, is mounted to the outside of the outer casing 1 (see FIG. 10), in order to make the load terminals distinguishable from the power source terminals (for example, in order to arrange the load terminals on the front and the power source terminals on the rear) or in order to improve the assemblability of the load terminals. A cable or a bus bar may be used as the connecting conductor 4*c*.

Since the DC circuit breaker according to the conventional art requires an U-shaped externally connected conductor 4*a* or a connecting conductor 4*c* on the outside of the outer casing 1, additional user operation is needed. Moreover, the conductive connection structure exposed out of the outer casing 1 may cause a possible insulation breakdown and take up more space. Additionally, even when adjacent phases (poles) are integrally connected by a U-shaped externally connected conductor, two tripping mechanisms (trip portions) still exist, and this redundancy leads to a waste of components.

SUMMARY OF THE INVENTION

The present invention has been made in an effort to solve the above-described problems, and an aspect of the present invention is to provide a molded-case circuit breaker for DC that contains an internal connecting conductor connecting adjacent terminals to improve insulation performance and assemblability and reduce occupied space.

An exemplary embodiment of the present invention provides a molded-case circuit breaker for DC that contains a plurality of interruption units within an outer casing, the DC circuit breaker including a two-unit connecting heater that connects fixed contacts of adjacent interruption units, the two-unit connecting heater being placed within the outer casing.

The two-unit connecting heater may be formed in a U-shape, and may include: a pair of head portions respectively connected to the fixed contacts of the adjacent interruption units; a pair of body portions extending downward from the head portions; and a leg portion connecting the pair of body portions.

The head portions and the leg portion may be horizontal planes, and the body portions may be vertical planes.

One of the pair of body portions may have a tripping mechanism that detects an over-current in a circuit and interrupts the circuit.

Front terminal receiving portions and rear terminal receiving portions may be provided on the front and rear of the outer casing, and insulation covers may be provided to close the front terminal receiving portions or the rear terminal receiving portions.

A trip portion case for receiving the two-unit connecting heater and the tripping mechanism may be placed within the outer casing, and a trip portion insulation cover may be provided on the front of the trip portion case.

Assembly holes may be formed in the leg portion so as to couple with the trip portion case.

The trip portion case may have a partition for insulation between the interruption units, and a cut groove may be formed on a part of the partition to insert the leg portion.

The DC circuit breaker may further include a connecting conductor, one end of which is connected to a rear terminal of an interruption unit on one side, and the other end of which is mounted in the front terminal receiving portion of the interruption unit on one side, with the connecting conductor being mounted within the outer casing.

The connecting conductor may include: a first terminal attached to the rear terminal of the interruption unit on one side; a second terminal mounted in the front terminal receiving portion of the interruption unit on one side; and a connecting portion connecting the first terminal and the second terminal.

The outer casing may include: a box-shaped case with the top and part of the front and rear being open; and a cover attached to the top of the case, wherein the case may have a first protrusion protruding from the bottom of one sidewall, the first protrusion may have a first receiving slot formed along the length, the cover may have a second protrusion protruding out from one sidewall, and the second protrusion may have a second receiving slot formed along the length to communicate with the first receiving slot, with the connecting conductor being inserted into the first and second receiving slots.

An extension may extend downward along the outer wall of the second protrusion, and the extension may have such a length at which it can adjoin the first protrusion.

The second protrusion may have the same width as the first protrusion.

A cut groove may be formed on one sidewall of the case to insert part of the connecting conductor.

According to a molded-case circuit breaker for DC according to an embodiment of the present invention, a U-shaped two-unit connecting heater is provided to connect a pair of adjacent units and therefore no front terminals and no externally connected conductors are required. Accordingly, the user does not need to add more connecting conductors, and the assemblability of the power source and load is improved.

Moreover, external insulation breakdown is prevented since a connecting conductor is configured within the outer casing. In addition, no front terminal portion is needed, thus improving insulation performance and reducing occupied space.

Further, the number of tripping mechanisms can be reduced, thus leading to a reduction in parts and production cost.

According to a molded-case circuit breaker for DC according to another embodiment of the present invention, the circuit breaker has a connecting conductor within it, the power source terminals and the load terminals are configured on the front and rear of the DC circuit breaker in an easily distinguishable manner. Thus, the user does not need to add more connecting conductors, and the assemblability of the power source and load is improved.

Moreover, external insulation breakdown is prevented since the connecting conductor is configured within the outer casing. In addition, part of the terminal portion is eliminated, thus enhancing insulation from the outside.

Further, unlike a heater provided at the R phase, a U-shaped, two-unit connecting heater is provided at the S phase and the T phase to directly connect them, and therefore the number of tripping mechanisms can be reduced, thus leading to a reduction in parts and production cost.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE PREFERRED EMBODIMENTS

While the invention has been shown and described with respect to the preferred embodiments, it will be understood by those skilled in the art that various changes and modifications may be made without departing from the spirit and scope of the invention as defined in the following claims.

A molded-case circuit breaker for DC according to embodiments of the present invention will be described in detail with reference to the drawings.

A molded-case circuit breaker for DC with a plurality of interruption units according to an embodiment of the present invention includes: a two-unit connecting heater 41 that connects fixed contacts 33*b* of adjacent interruption units, with the two-unit connecting heater 41 being placed within an outer casing of the circuit breaker.

Figure 11:
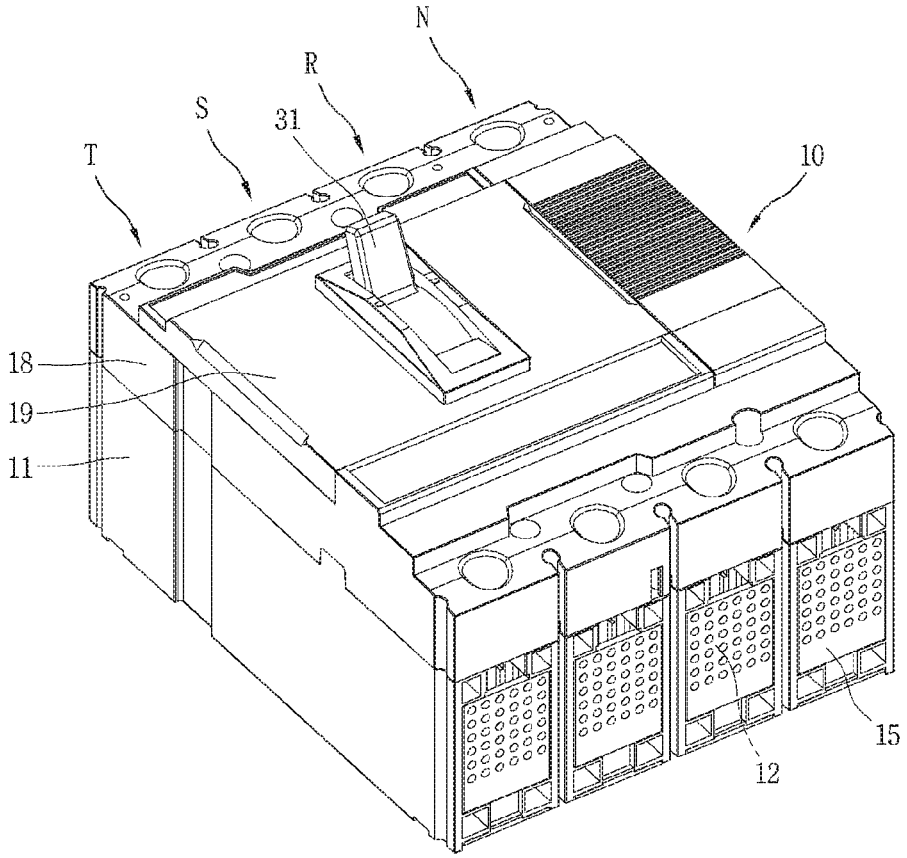
FIGS. 11 and 12 are front and rear perspective views of a molded-case circuit breaker for DC according to an embodiment of the present invention.
Figure 12:
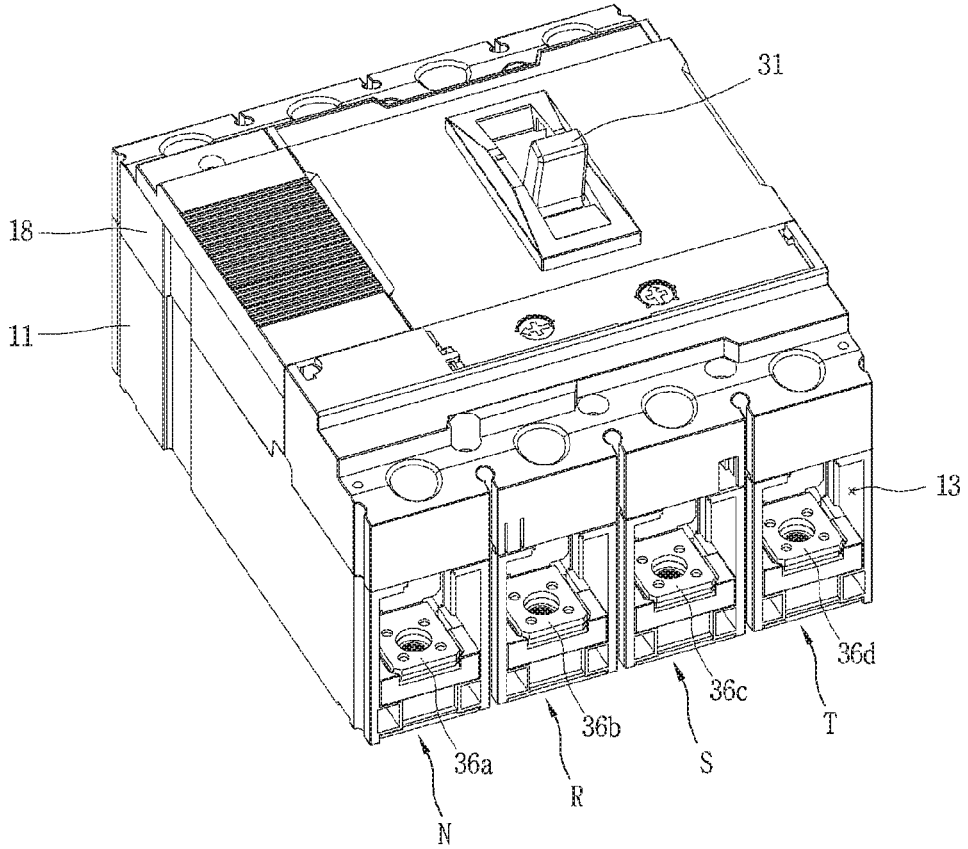
Figure 13:
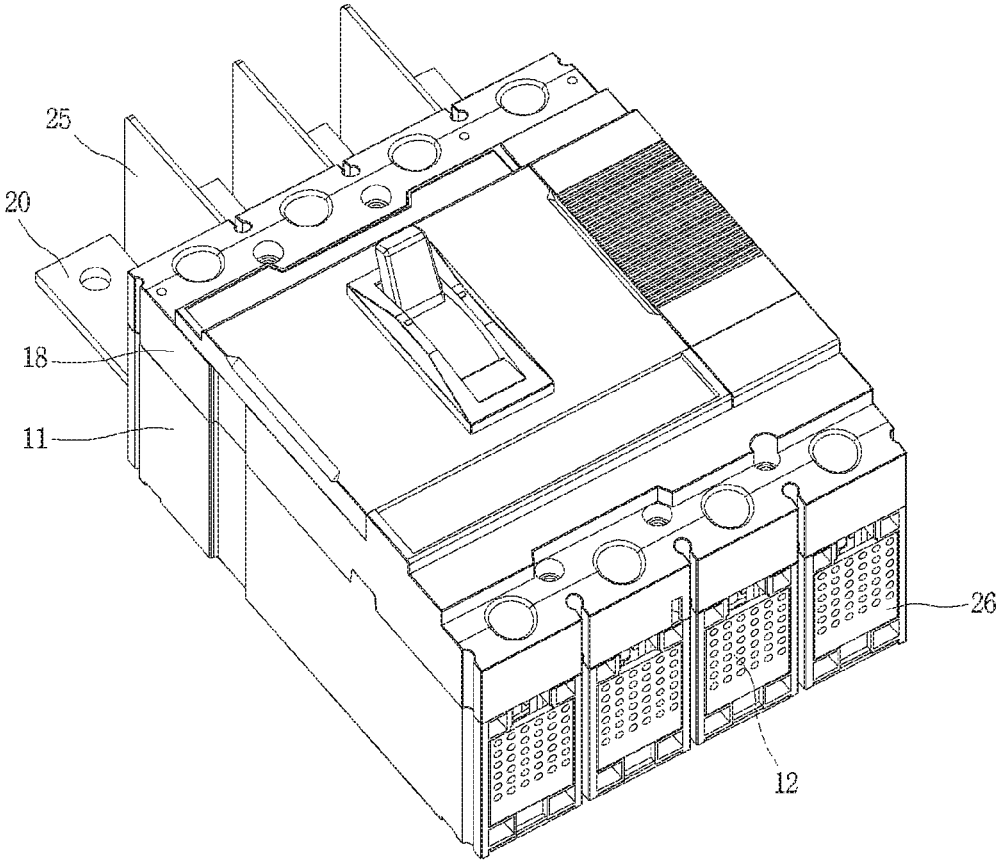
FIG. 13 is a perspective view of the circuit breaker of FIG. 11 with externally connected conductors attached to it.
Figure 14:
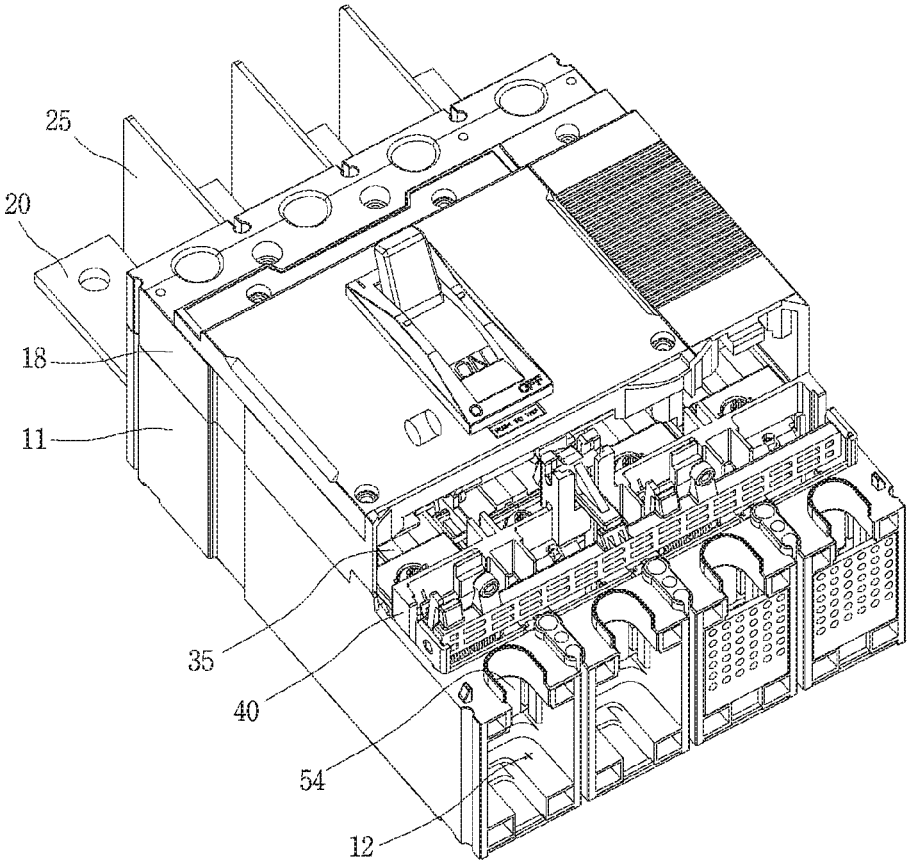
FIG. 14 is a perspective view of the circuit breaker of FIG. 13, from which the cover is partially cut away.
Figure 15:
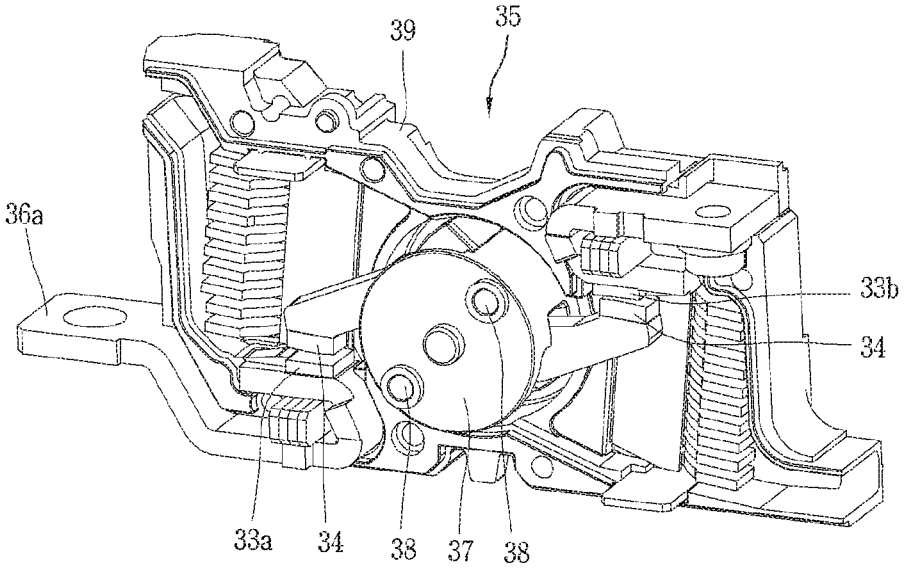
FIGS. 15 and 16 are perspective views of a base assembly and a trip portion assembly applied to a molded-case circuit breaker for DC according to an embodiment of the present invention.
Figure 16:
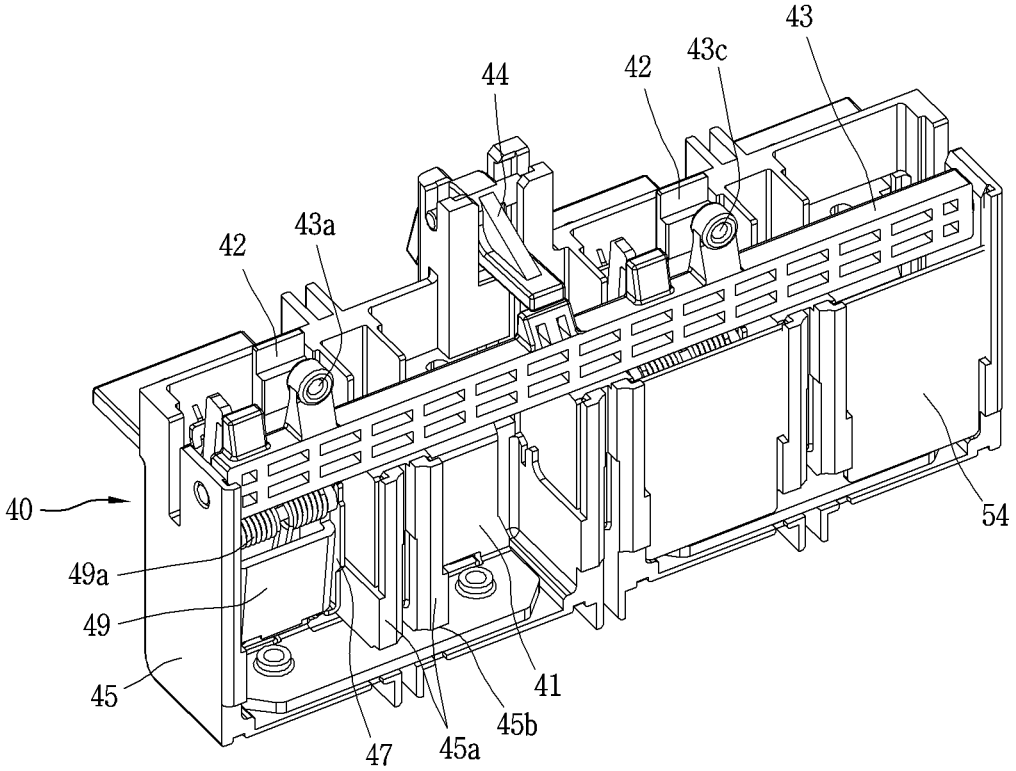

FIGS. 11 and 12 depict front and rear perspective views of a molded-case circuit breaker for DC according to an embodiment of the present invention. FIG. 13 depicts a perspective view of the circuit breaker of FIG. 11 with externally connected conductors attached to it. FIG. 14 is a perspective view of the circuit breaker of FIG. 13, from which the cover is partially cut away. FIGS. 15 and 16 are perspective views of a base assembly and a trip portion assembly applied to a molded-case circuit breaker for DC according to an embodiment of the present invention.

A molded-case circuit breaker for DC according to an embodiment of the present invention includes a plurality of interruption units. The interruption units correspond to interruption units applied to respective phases (poles) of a molded-case circuit breaker for AC. Therefore, for better comprehension, a four-unit molded-case circuit breaker will be described with respect to the R phase, S phase, T phase, and N phase. A DC four-unit circuit breaker 10 according to an embodiment of the present invention includes a case 11 and a cover 18 that constitute an outer casing, a switch mechanism 30 (see FIG. 25) that provides opening and closing forces, a base assembly 35 provided for each phase and having a contact portion, a trip portion assembly 40 provided on the front of the base assembly 35, and a two-unit connecting heater 41.

The case 11 forms the bottom of the outer casing. The case 11 may have the approximate shape of a box with its top and part of its front and rear being open. The base assembly 35 is accommodated in the internal space of the case 11. Since the four-unit circuit breaker has a four-unit circuit of the R phase, S phase, T phase, and N phase, it contains four base assemblies 35. The case 11 may be divided into four segments. FIG. 11 depicts an example in which the N phase, R phase, S phase, and T phase are arranged in this order from right. Front terminal receiving portions 12 and rear terminal receiving portions 13 are provided on the front and rear of the case 11. The front terminal receiving portions 12 and the rear terminal receiving portions 13 provide a space where a load terminal or power source terminal can be mounted. The terminal receiving portions on either the front or rear (the front in this embodiment) remain unoccupied.

The cover 18 is attached to the top of the case 11. The top side of the cover 18 is partially open, with a top cover 19 mounted on it. A handle 31 of the switch mechanism 30 is exposed through a hole at the center of the top cover 19, thereby allowing the user to manually apply an actuating force to it.

The front terminal receiving portions 12 may be covered with insulation covers 26. As the front terminal receiving portions 12 have no terminals mounted in them, they are covered with the insulation covers 26, thus improving insulation performance. FIG. 14 shows that some of the front terminal receiving portions 12 have no terminals mounted in them since the insulation covers 26 have been removed.

In the rear terminal receiving portions 13, terminals of the respective phases are mounted and exposed. That is, an N phase terminal 36*a*, an R phase terminal 36*b*, an S phase terminal 36*c*, and a T phase terminal 36*d* are provided in terminal receiving portions of the respective phases, respectively.

FIGS. 13 and 14 show that externally connected conductors 20 are attached to the respective terminals of the rear terminal receiving portions 13. The externally connected conductors 20 are provided to facilitate attachment of the positive and negative terminals of a power source 60*a* and 60*b* or load 70. The externally connected conductors 20 may be formed from an I-shaped flat plate.

An insulation barrier 25 may be provided between each externally connected conductor 20. The insulation barrier 25 improves insulation between each phase.

The base assembly 35 and the trip portion assembly 40 will be described with reference to FIGS. 14 to 16. The base assembly 35 is provided for each phase. In the four-unit circuit breaker, four base assemblies 35 to be respectively applied to the N phase, R phase, S phase, and T phase are arranged in parallel. Each base assembly 35 has a contact portion within a base mold 39 formed from an injection-molded material. The contact portion includes fixed contacts 33*a* and 33*b* and movable contacts 34. As depicted in FIG. 15, in the case of twin contact type, the contact portion includes fixed contacts consisting of a rear fixed contact 33*a* and a front fixed contact 33*b* and symmetrical movable contacts 34. The rear fixed contact 33*a* is connected to the terminal 36*a*, 36*b*, 36*c*, or 36*d* of each phase. The rear fixed contact 33*a* and the terminal 36*a*, 36*b*, 36*c*, or 36*d* of each phase may be integrally formed. The terminal 36*a*, 36*b*, 36*c*, or 36*d* of each phase protrudes from one side (the rear side) of the base assembly 35, and the base assembly 35 is exposed through the rear terminal receiving portion 13 when attached to the case 11. Among the terminals 36*a*, 36*b*, 36*c*, and 36*d* of the respective phases, the N phase terminal 36*a* and the T phase terminal 36*d* may be connected to the power source 60*a* and 60*b*. Also, the R phase terminal 36*b* and the S phase terminal 36*c* may be connected to the load 70.

The movable contacts 34 are mounted on a shaft 37 and rotate with the shaft 37. Each shaft 37 is connected by a shaft pin 38 and all the shafts 37 rotate together, thereby causing the contact portions of the four units to open and close simultaneously. The switch mechanism 30 is mounted on the base assembly 35 of a certain phase, typically, the S phase base assembly, and transfers actuating force to the shaft pin 38 that is attached to a part of the switch mechanism 30. The operations of the movable contacts and switch mechanism 30 are identical to those in the conventional art, so any further detailed descriptions of them will be omitted.

The trip portion assembly 40 is mounted on the front of the base assembly 35. The trip portion assembly 40 detects an over-current flow in a circuit and interrupts it, and may include a trip portion case 45, a two-unit connecting heater 41 connected to a pair of adjacent front fixed contacts, bimetal 42 that can be bent by heat, a crossbar 43 that is rotated by the bimetal 42, and a chute 44 that rotates when released from the crossbar 43 to strike a nail 32 of the switch mechanism 30 and allow the switch mechanism 30 to perform an off operation.

The crossbar 43 may have a plurality of contact regions 43*a* and 43*c* that protrude to make contact with the bimetal 42. Each contact region may be formed at only one of two adjacent phases. For example, the first contact region 43*a* is provided at one of the S and T phases, and the second contact region 43*c* is provided at one of the N and R phases. That is, no contact region may be provided at the other of the S and T phases and the other of the N and R phases.

A tripping mechanism is common to two adjacent phases. For example, a tripping mechanism may be provided for a pair of interruption units connecting the N phase and the R phase and also for a pair of interruption units connecting the S phase and the T phase.

The trip portion case 45 has a partition 45*a* for insulation between each phase (unit). The partition 45*a* may be made from a double wall to improve insulation performance. A cut groove 45*b* may be formed by partially cutting away the bottom of the partition 45*a*. A leg portion 41*c* of the two-unit connecting heater 41 may be inserted into the cut groove 45*b*.

A trip portion insulation cover 54 is provided on the front of the trip portion case 45. The trip portion insulation cover 54 may be formed to completely close the front of the trip portion case 45. Insulation performance can be improved because the trip portion is insulated by the trip portion insulation cover 54. Insulation performance can be greatly improved because the front terminal receiving portions 12 each have a double wall that is formed by an insulation cover 26 and the trip portion insulation cover 54.

Figure 17:
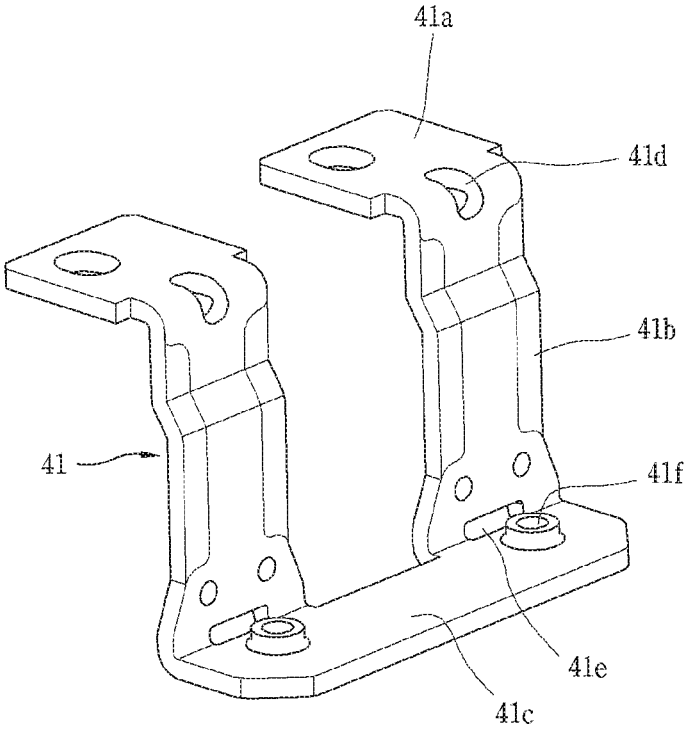
FIG. 17 is a perspective view of a two-unit connecting heater applied to a molded-case circuit breaker for DC according to an embodiment of the present invention.
Figure 18:
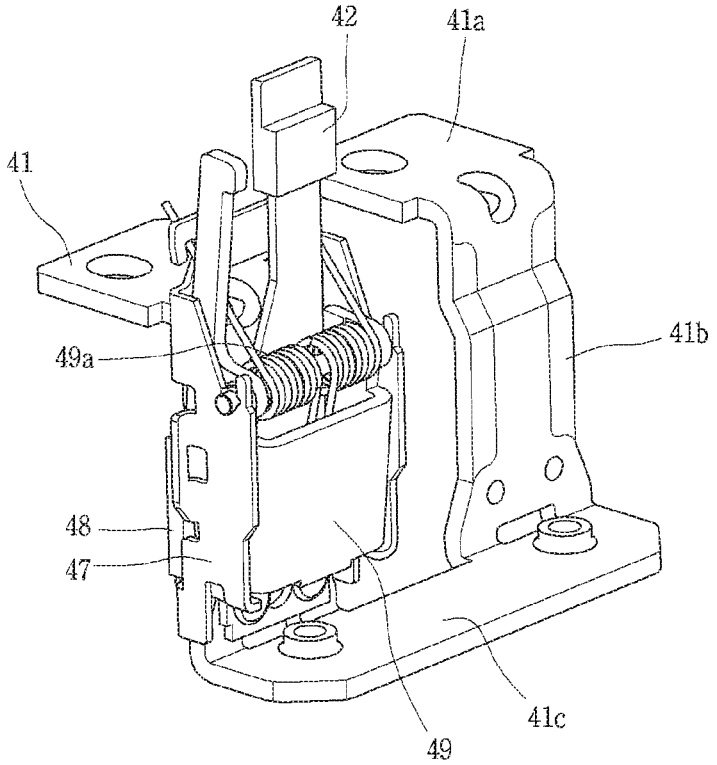
FIG. 18 is a perspective view of a tripping mechanism attached to a two-unit connecting heater applied to a molded-case circuit breaker for DC according to an embodiment of the present invention.

Referring further to FIGS. 16 to 18, the two-unit connecting heater 41 is provided to connect the front fixed contacts 33*b* of a pair of adjacent front phases (e.g., the S phase and the T phase). The two-unit connecting heater 41 is formed in a U-shape. One end of the two-unit connecting heater 41 is connected to the front fixed contact 33*b* of any one (e.g. the S phase) of the pair of adjacent phases, and the other end of the two-unit connecting heater 41 is connected to the front fixed contact 33*b* of the other (e.g. the T phase) of the pair of adjacent phases. Tripping mechanism components may be provided on one side (either the S phase or the T phase) of the two-unit connecting heater 41. That is, the components of the tripping mechanism, except the heater, including a fixing bracket 47, a magnet 48, an amarteur 49, and a trip spring 49*a*, may be provided at one (e.g., the S phase) of a pair of adjacent phases but not at the other phase (e.g., the T phase).

The two-unit connecting heater 41 may include a pair of head portions 41*a* connectable to a pair of adjacent front fixed contacts 33*b*, a pair of body portions 41*b* extending downward from the head portions 41*a*, and a leg portion 41*c* connecting the pair of body portions 41*b*. The head portions 41*a* and the leg portion 41*c* may be horizontal planes, and the body portions 41*b* may be vertical planes. The body portions 41*b* may be partially bent so as to keep a certain distance from the tripping mechanism. Center holes 41*d* and 41*e* may be formed in the regions of contact between the head portions 41*a* and the body portions 41*b* and the regions of contact between the body portions 41*b* and the leg portion 41*c*, in order to improve strength and facilitate the formation of bends. Also, assembly holes 41*f* may be formed in the leg portion 41*c* so as to couple with the trip portion.

Figure 1:
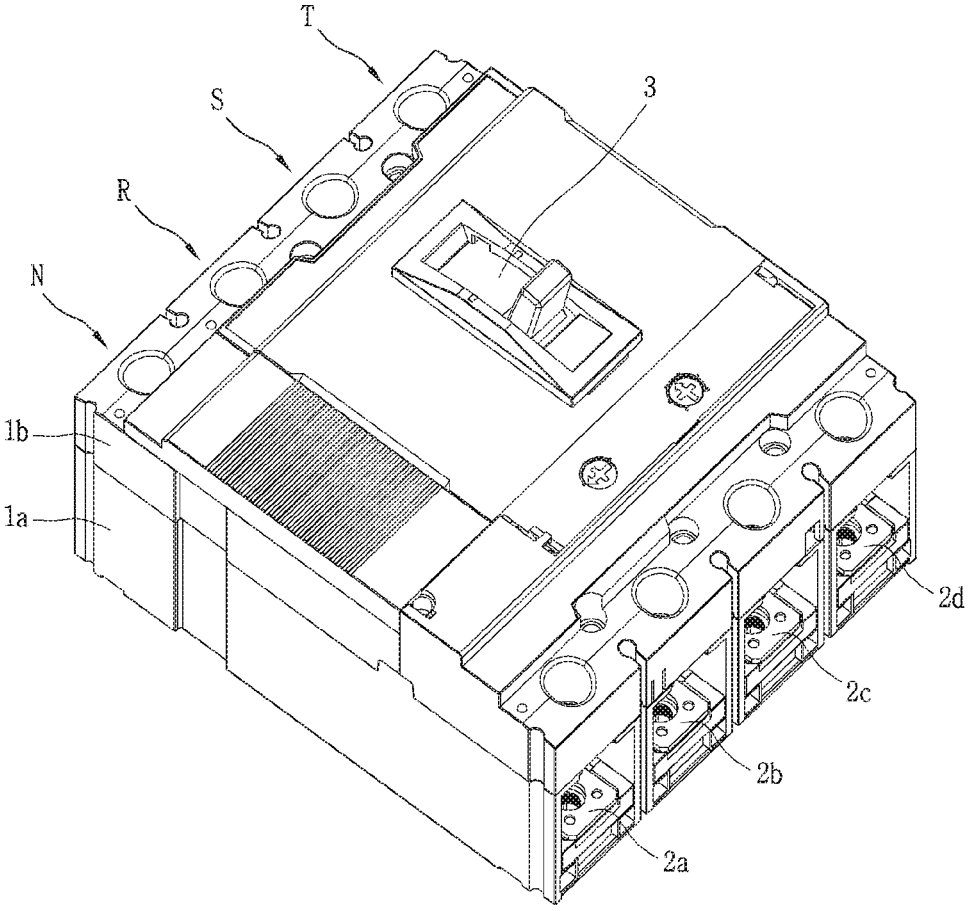
FIG. 1 PRIOR ART
FIG. 1 is a perspective view of a four-pole molded-case circuit breaker for AC according to the conventional art.
Figure 2:
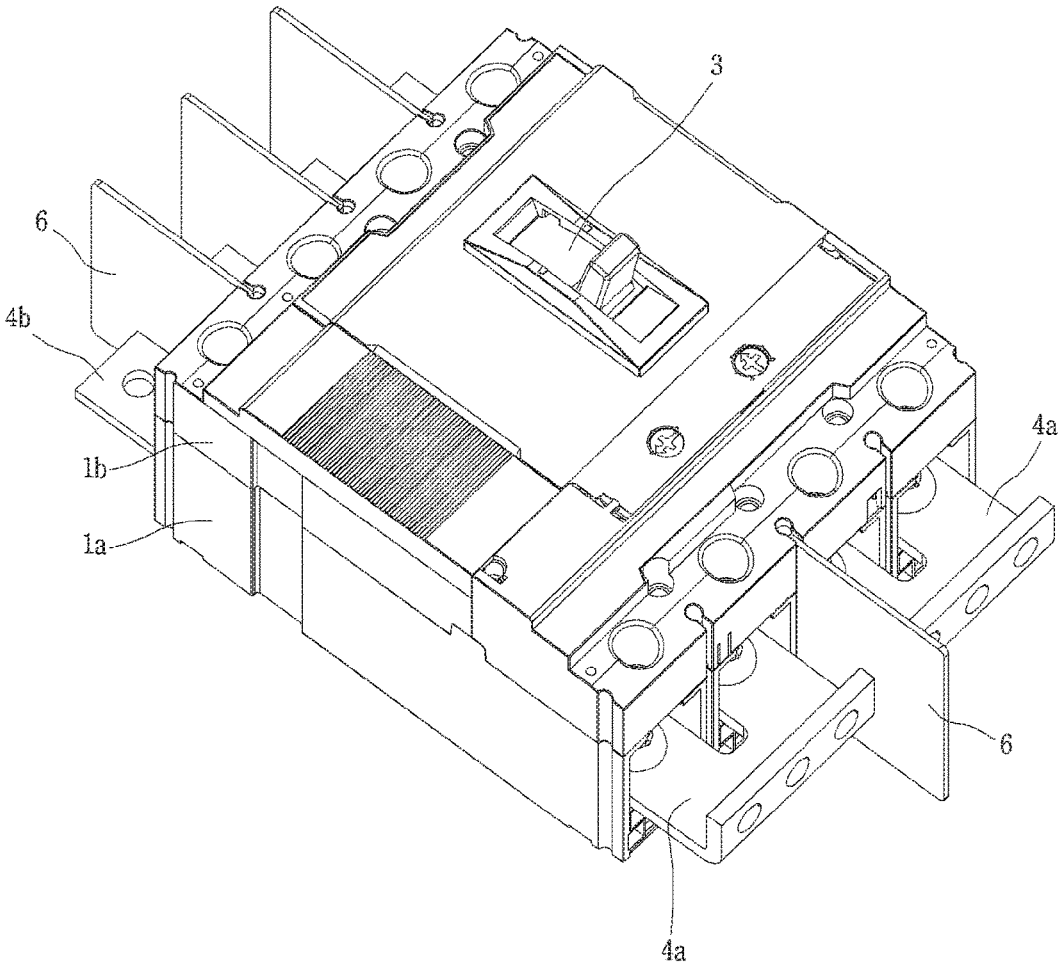
FIG. 2 PRIOR ART
FIG. 2 is a perspective view of a four-unit molded-case circuit breaker for DC according to the conventional art.
Figure 3:
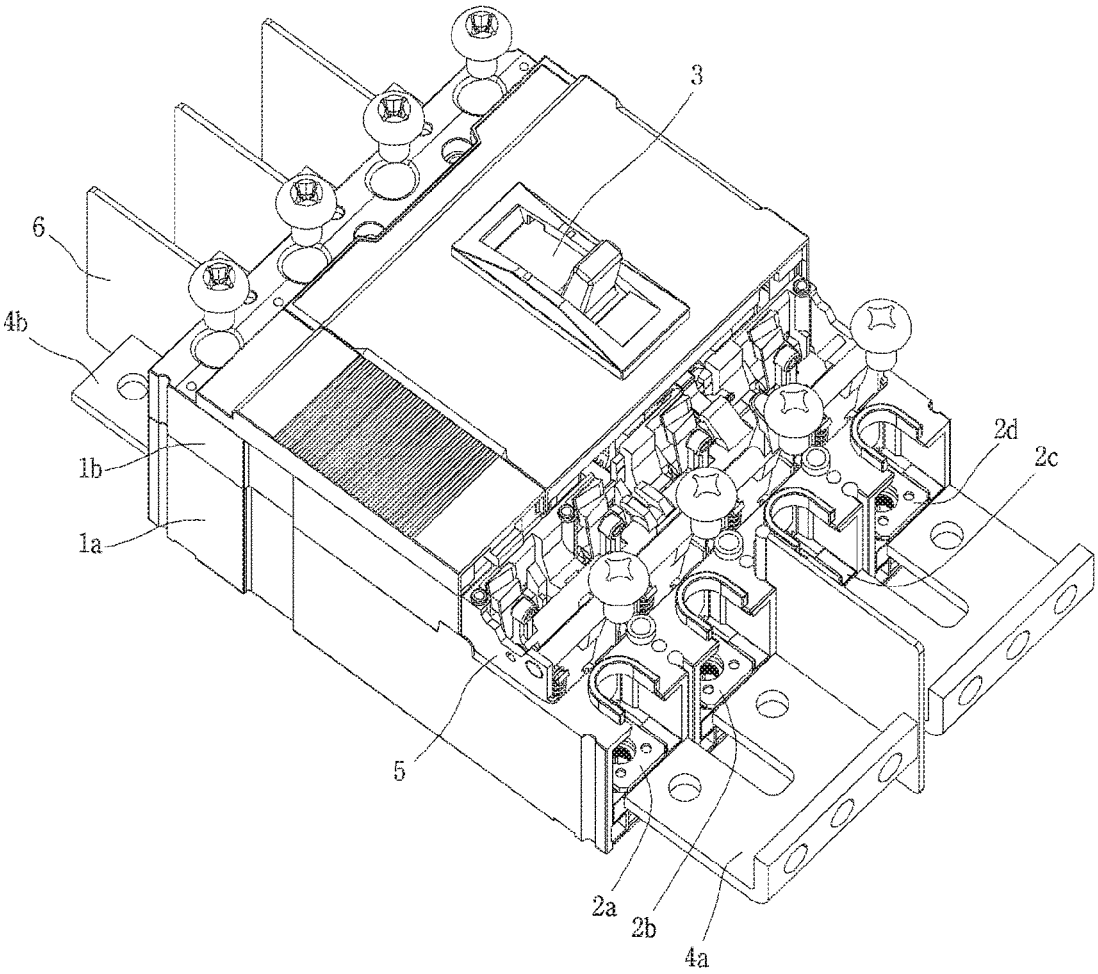
FIG. 3 PRIOR ART
FIG. 3 is an internal perspective view of the circuit breaker of FIG. 2, from which the cover is partially cut away and the externally connected conductors are separated.
Figure 4:
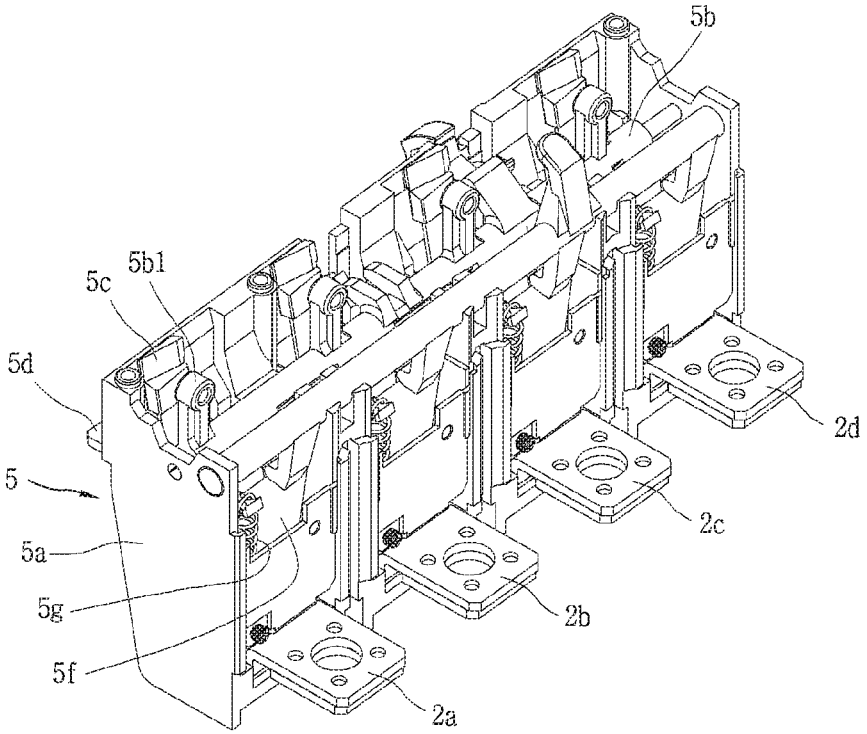
FIG. 4 PRIOR ART
FIG. 4 is a perspective view of a trip portion shown in FIG. 3.
Figure 5:
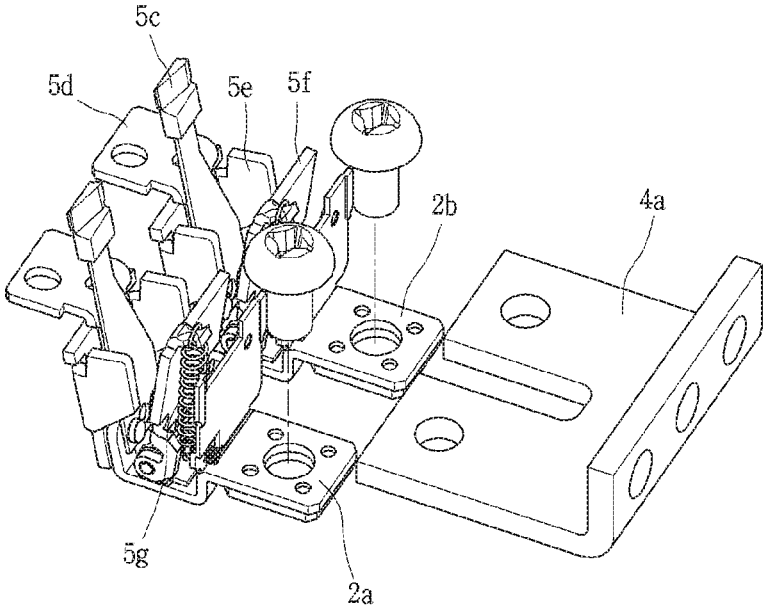
FIG. 5 PRIOR ART
FIG. 5 is an exploded perspective view of tripping mechanisms, terminals, and an externally connected conductor shown in FIG. 4.
Figure 6:
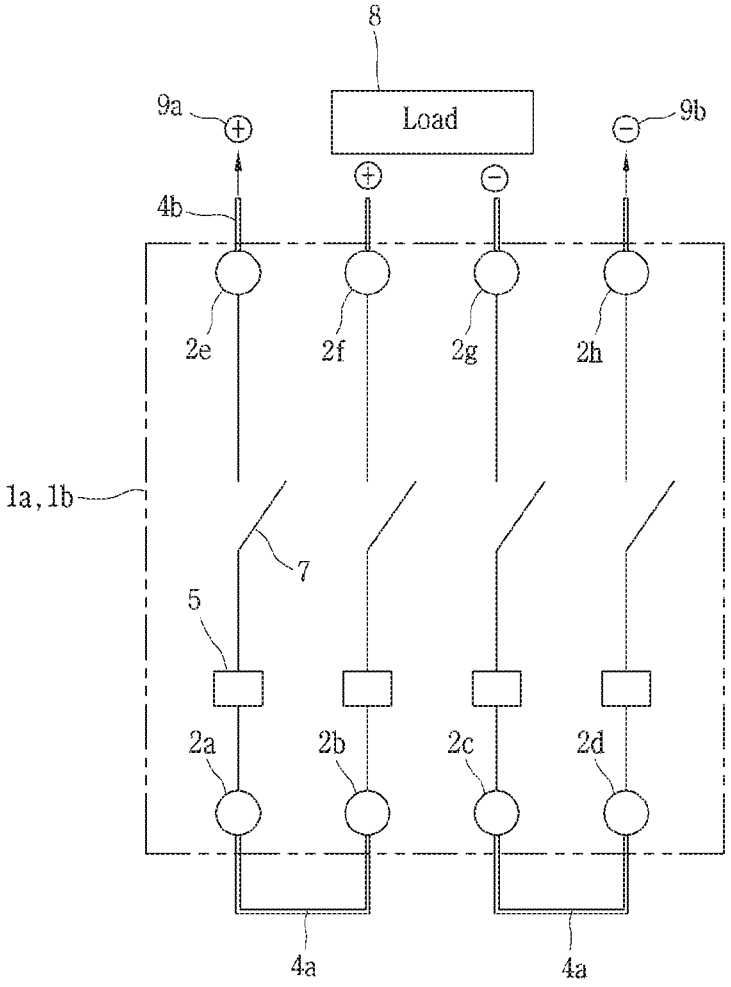
FIG. 6 PRIOR ART
FIG. 6 is a wiring diagram of the four-unit molded-case circuit breaker for DC according to the conventional art.
Figure 7:
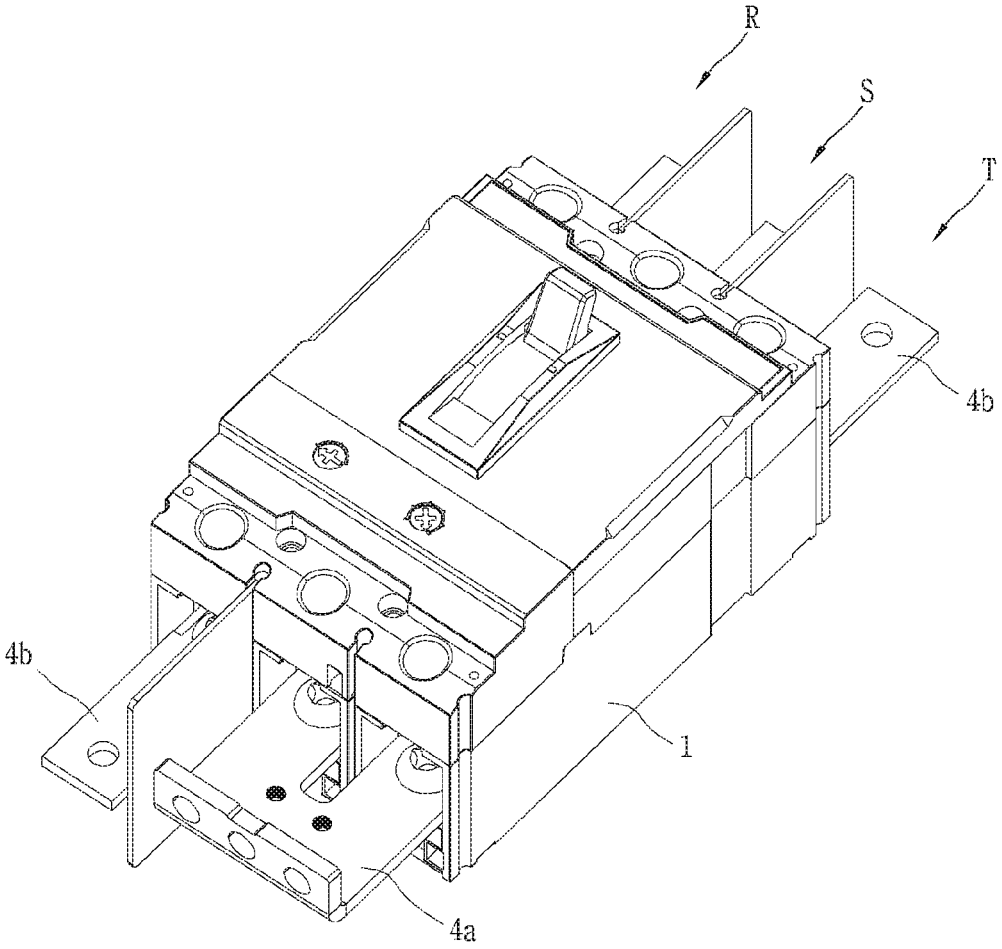
FIG. 7 PRIOR ART
FIG. 7 is perspective view of a three-unit molded-case circuit breaker for DC according to the conventional art.
Figure 8:
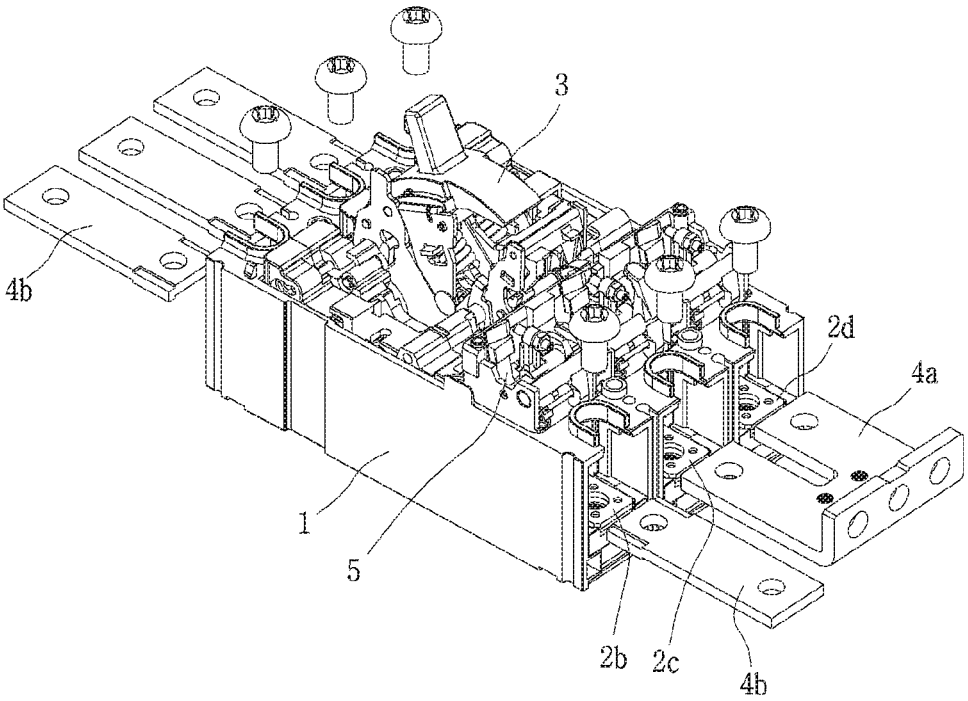
FIG. 8 PRIOR ART
FIG. 8 is an internal structure diagram of the three-unit molded-case circuit breaker for DC according to the conventional art, from which the cover is removed.

A pair of adjacent phases (e.g., the S phase and the T phase) are connected by the two-unit connecting heater 41, and it means that two phases may be covered by one heater. Moreover, the two-unit connecting heater 41 serves as a current-carrying path. Therefore, the two-unit connecting heater 41 requires no front terminals (2*a*, 2*b*, 2*c*, and 2*d* in the conventional art) (compare FIG. 1 and FIG. 14 and compare FIG. 4 and FIG. 16).

Since a pair of adjacent phases are directly connected by the two-unit connecting heater 41, a pair of adjacent terminals and an externally connected conductor connecting them are unnecessary. Thus, there are no components that are exposed out of the front terminal receiving portions 12. Accordingly, insulation performance is improved.

Moreover, since the front terminal receiving portions 12 have no terminals within them and therefore no components are exposed externally, the front terminal receiving portions 12 may be covered by the insulation covers 26. Accordingly, insulation performance is further improved.

In addition, the tripping mechanism 41A (which collectively refers to 42, 46, 47, 48, and 49) is provided on any one of a pair of adjacent phases, thus reducing the number of parts and cutting costs.

Figure 19:
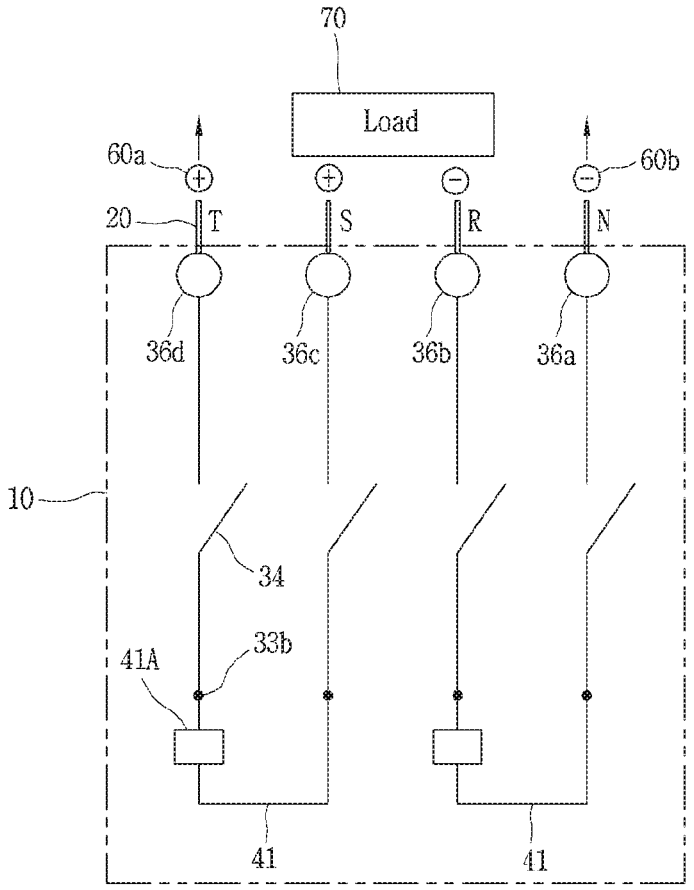
FIG. 19 is a wiring diagram of a molded-case circuit breaker for DC according to an embodiment of the present invention.

A wiring diagram of a four-unit molded-case circuit breaker for DC according to an embodiment of the present invention will be described with reference to FIG. 19.

The power source 60*a* and 60*b* and the load 70 are connected to the terminals of respective phases provided on the rear of the DC circuit breaker 10. For example, the plus pole 60*a* of the power source 60*a* and 60*b* is connected to the T phase terminal 36*a*, and the minus pole of the power source 60*a* and 60*b* is connected to the N phase terminal 36*b* on the power source side. Also, the plus pole of the load 70 is connected to the S phase terminal 36*c*, and the minus pole of the load 70 is connected to the R phase terminal 36*b*.

To connect a pair of adjacent phases, the two-unit connecting heater 41 is attached to the pair of adjacent front fixed contacts. Since the pair of adjacent phases is connected directly by the two-unit connecting heater 41, no front terminals and no externally connected conductors are required. Also, the two-unit connecting heater 41 is contained within the outer casing of the DC circuit breaker 10, it is closed off from the outside, thus improving insulation performance.

Only one trip mechanism 41A is provided for a pair of adjacent phases (units), but without a heater.

According to a molded-case circuit breaker for DC according to an embodiment of the present invention, a U-shaped two-unit connecting heater is provided to connect a pair of adjacent units and therefore no front terminals and no externally connected conductors are required. Accordingly, the user does not need to add more connecting conductors, and the assemblability of the power source and load is improved.

Moreover, external insulation breakdown is prevented since a connecting conductor is configured within the outer casing. In addition, no front terminal portion is needed, thus improving insulation performance and reducing occupied space.

Further, the number of tripping mechanisms can be reduced, thus leading to a reduction in parts and production cost.

Next, a molded-case circuit breaker with an odd number of poles (three poles) according to a second embodiment will be described. The same components as the foregoing embodiment will be denoted by the same reference numerals.

A DC circuit breaker 10A according to an aspect of the present invention includes a plurality of interruption units, an outer casing with front and rear terminal receiving portions 12 and 13 for each interruption unit provided on the front and rear, and a front terminal 55 and rear terminals 36*b*, 36*c*, and 36*d* for respective phases provided in the front and rear terminal receiving portions 12 and 13, with fixed contacts (not shown) of a unit on one side and an adjacent unit being connected together, and a power source 60 being connected to the rear terminals 36*c* and 36*d* of a unit on the other side and an adjacent unit. The DC circuit breaker 10A includes a connecting conductor 50, one end of which is connected to the rear terminal 36*b* of the unit on one side, and the other end of which is mounted in the front terminal receiving portion 12 of the unit on one side, with the connecting conductor 50 being mounted within the outer casing, and the load 70 being connected to the front terminal 55 of the unit on the other side and the other end of the connecting conductor 50.

A DC circuit breaker 10A according to another aspect of the present invention includes a plurality of interruption units, an outer casing with front and rear terminal receiving portions 12 and 13 for each interruption unit provided on the front and rear, and a front terminal 55 and rear terminals 36*b*, 36*c*, and 36*d* for respective phases provided in the front and rear terminal receiving portions 12 and 13, with fixed contacts (not shown) of a unit on one side and an adjacent unit being connected together, and a power source 60 being connected to the rear terminals 36*c* and 36*d* of a unit on the other side and an adjacent unit. The outer casing includes a case 11A with the top, front, and rear being open, and a cover 18A attached to the top of the case 11A, wherein the case 11A has a first protrusion 15 protruding from the bottom of one sidewall 14, the first protrusion 15 has a first receiving slot 16 formed along the length, the cover 18A has a second protrusion 22 protruding out from one sidewall 21, and the second protrusion 22 has a second receiving slot 23 formed along the length to communicate with the first receiving slot 16.

First, reference will be made with respect to FIGS. 20 to 25. This embodiment provides a circuit breaker with three interruption units. Therefore, for better comprehension, the circuit breaker will be described with respect to the R phase, S phase, and T phase. ADC three-unit circuit breaker 10 according to an embodiment of the present invention includes a case 11A and a cover 18A that constitute an outer casing, a switch mechanism 30, a base assembly 35 provided for each phase and having a contact portion, a trip portion assembly 40 provided on the load side (front) of the base assembly 35, and a connecting conductor 50.

The case 11A forms the bottom of the outer casing. The case 11A may have the approximate shape of a box with its top and part of its front and rear being open. The base assembly 35 is contained in the internal space of the case 11A. Since the three-unit circuit breaker has a three-phase circuit of the R phase, S phase, and T phase, it contains three base assemblies 35. Front terminal receiving portions 12 and rear terminal receiving portions 13 are provided on the front and rear of the case 11A. The front terminal receiving portions 12 and the rear terminal receiving portions 13 provide a space where a front terminal or rear terminal (a load terminal or power source terminal) can be mounted.

One sidewall (e.g., the outer wall of the R phase) 14 protrudes from the bottom and forms the first protrusion 15. The first protrusion 15 may be formed longitudinally along the sidewall 14. The first receiving slot 16 is formed along the length within the first protrusion 15. The connecting conductor 50 may be partially inserted into the first receiving slot 16.

An insertion slot 17 is formed on the front and rear ends of the sidewall 14. The insertion slot 17 communicates with the front terminal receiving portion 12 of the R phase or the rear terminal receiving portion 13 of the R phase.

The cover 18A is attached to the top of the case 11A. The top side of the cover 18A is open at the center, with a top cover 19 mounted to the open part. A handle 31 of the switch mechanism 30 is exposed through a hole at the center of the top cover 19, thereby allowing the user to manually apply an actuating force to it. One sidewall (e.g., the outer wall of the R phase) 21 of the cover 18A may protrude outward, thereby forming a second protrusion 22. The second protrusion 22 has the same width as the first protrusion 15 of the case 11A. The second protrusion 22 has a second receiving slot 23 formed within it that communicates with the first receiving slot 16. The first receiving slot 16 may be longitudinally formed along the length of the cover 18A. The connecting conductor 50 may be partially inserted into the first receiving slot 16.

An extension 24 extends downward along the outer wall of the second protrusion 22. The extension 24 may be referred to as a skirt. The extension 24 has such a length at which it can adjoin the first protrusion 15 of the case 11A. The cover 18A is symmetrical with respect to a vertical cross-section since the second protrusion 22 and the extension 24 are formed on one side of the cover 18A.

The first protrusion 15 is provided on the case 11A, and the second protrusion 22 is provided on the cover 18A. Thus, the connecting conductor 50 is inserted and mounted into the first receiving slot 16 of the first protrusion 15 and the second receiving slot 23 of the second protrusion 22 and therefore not exposed to the outside.

Figure 25:
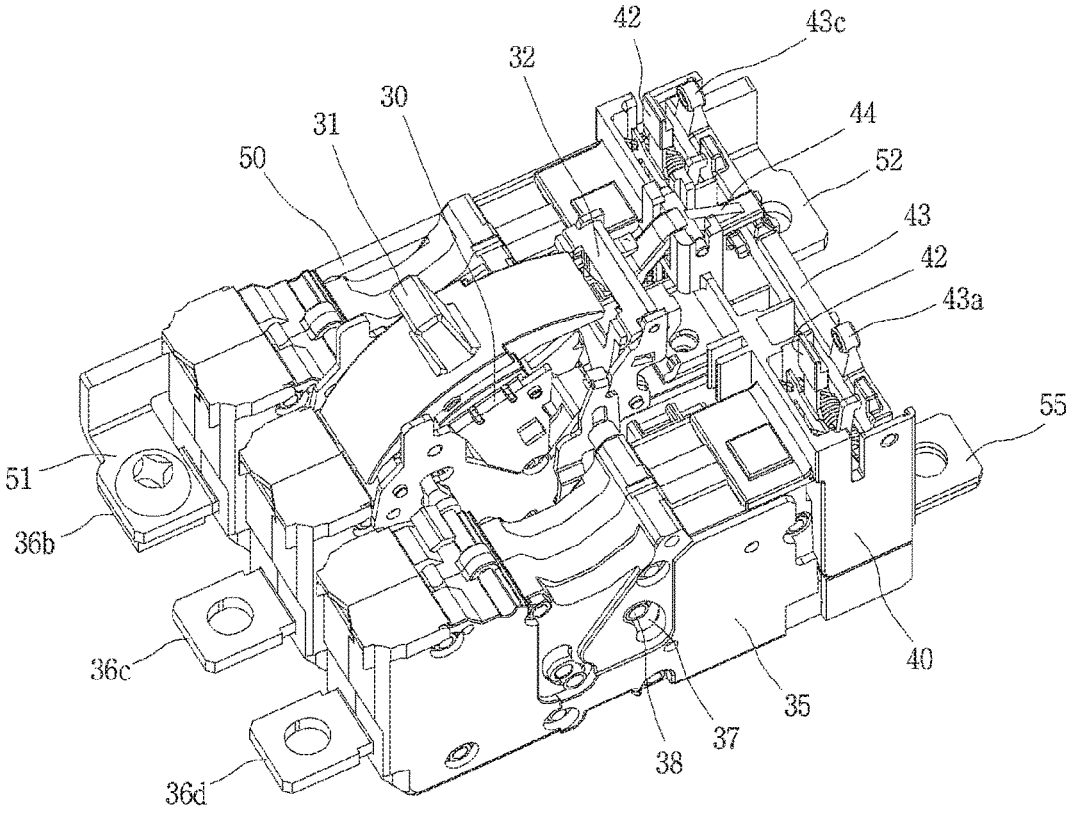
FIG. 25 is an internal structure diagram of a three-unit molded-case circuit breaker for DC according to an embodiment of the present invention, from which the case and the cover are removed.
Figure 26:
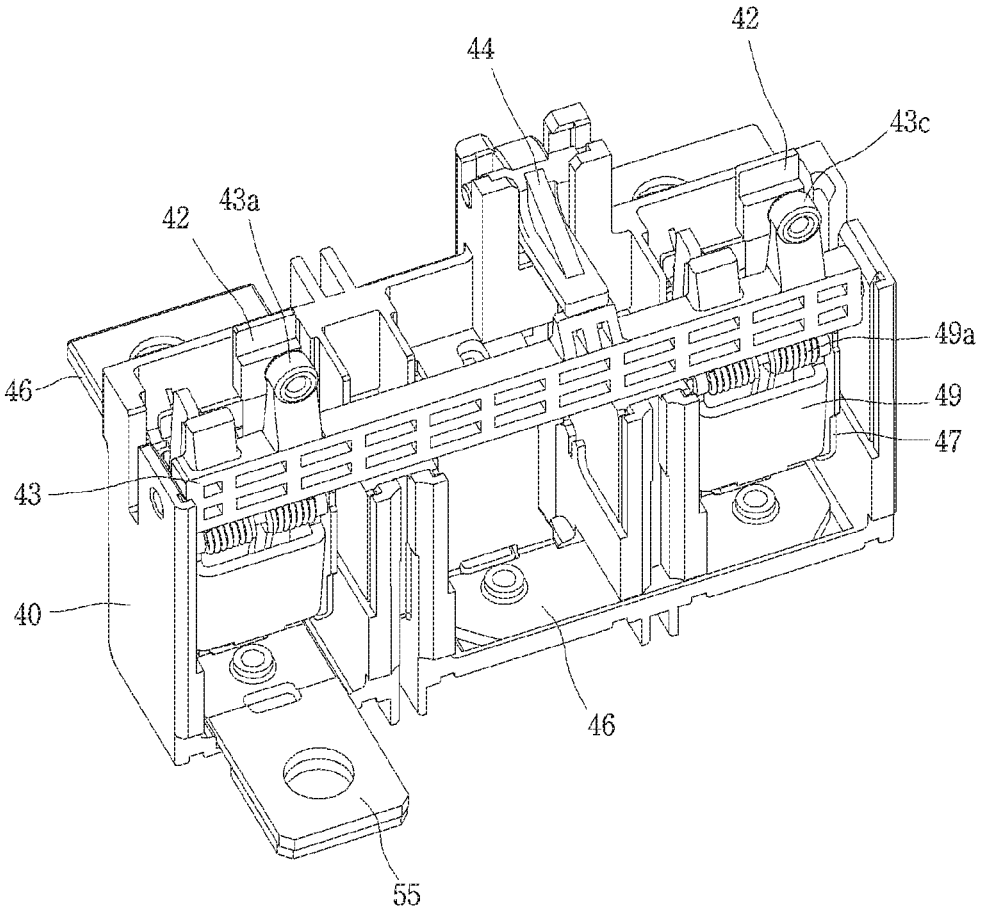
FIG. 26 is a perspective view of the trip portion assembly of FIG. 20.

The base assembly 35 and the trip portion assembly 40 will be described with reference to FIGS. 21, 25, and 26. The base assembly 35 is provided for each phase. In the three-unit circuit breaker, three base assemblies 35 to be respectively applied to the R phase, S phase, and T phase are arranged in parallel. Each base assembly 35 has a contact portion within it. The contact portion includes fixed contacts and movable contacts. The rear fixed contact extends to form the rear terminal 36*b*, 36*c*, or 36*d* of the R, S, or T phase. The rear terminal 36*b*, 36*c*, and 36*d* of each phase protrudes from one side of the base assembly 35. Among the rear terminals 36*b*, 36*c*, and 36*d* of the respective phases, the S phase terminal 36*c* and the T phase terminal 36*d* may be exposed through the rear terminal receiving portions 13 and connected to the power source 60.

The movable contacts 34 are mounted on a shaft 37 and rotate with the shaft 37. Each shaft 37 is connected by a shaft pin 38 mounted to pass through the three phases and all the shafts 37 rotate together, thereby causing the contact portions of the three units to open and close simultaneously. The switch mechanism 30 is mounted on the base assembly 35 of a certain phase, typically, the S phase base assembly, and transfers actuating force to the shaft pin 38 that is attached to a part of the switch mechanism 30. The operations of the movable contacts and switch mechanism 30 are identical to those in the conventional art, so any further detailed descriptions of them will be omitted.

Figure 9:
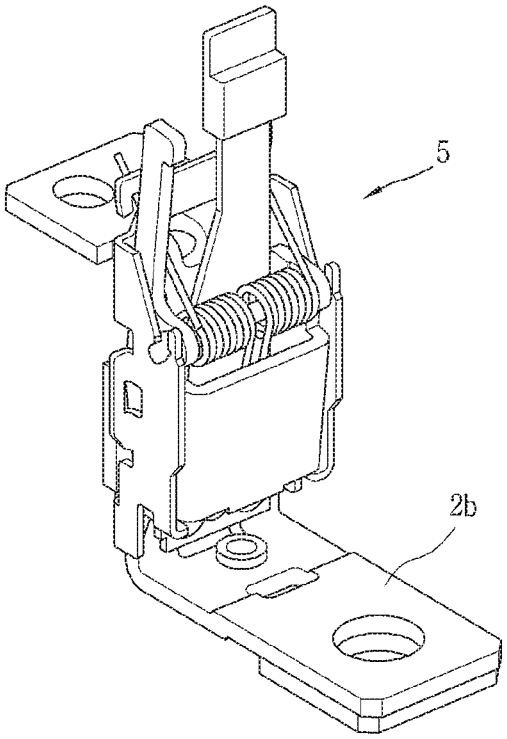
FIG. 9 PRIOR ART
FIG. 9 is a perspective view of a trip portion and a terminal shown in FIG. 8.
Figure 10:
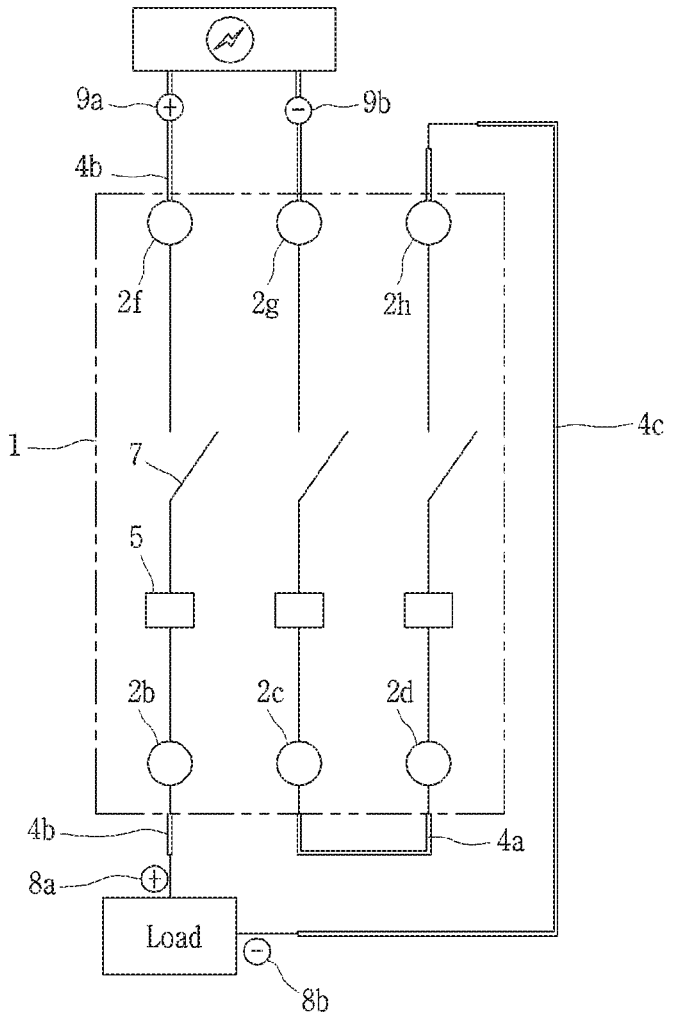
FIG. 10 PRIOR ART
FIG. 10 is a wiring diagram of the three-unit molded-case circuit breaker for DC according to the conventional art.

The trip portion assembly 40 is mounted on the load side of the base assembly 35. The trip portion assembly 40 interrupts an over-current flow in a circuit, and may include heaters 41 and 46 connected to fixed contacts on the load side, bimetal 42 that can be bent by heat, a crossbar 43 that is rotated by the bimetal 42, and a chute 44 that rotates when released from the crossbar 43 to strike a nail 32 of the switch mechanism 30 and allow the switch mechanism 30 to perform an off operation. In this case, the T-phase trip mechanism may be identical to the conventional trip mechanism. That is, the heater 46 and bimetal 42 of the T phase trip mechanism may be identical to the heater and bimetal according to the conventional art (see FIGS. 9 and 26). Moreover, the T phase front terminal (load terminal) 45 may be connected to the heater 41 and exposed through the front terminal receiving portions 12. In some embodiments, the T phase front terminal 55 may be formed integrally with the heater 46.

The crossbar 43 has a plurality of contact regions 43*a* and 43*c* that protrude to make contact with the bimetal 42. The contact regions may be formed at two phases. For example, the first contact region 43*a* is provided at the T phase, and the second contact region 43*c* is provided at the R phase or the S phase. That is, no contact region may be provided at one of the R and S phases.

Figure 28:
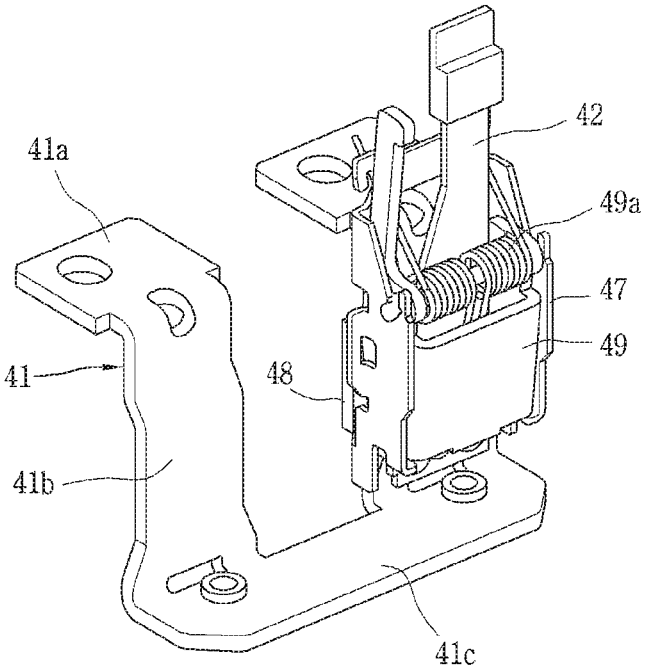

Referring further to FIG. 28, the R phase and the S phase may have a single, common tripping mechanism. A two-unit connecting heater 41 connecting the R phase and the S phase is provided.

The S phase and the T phase are connected by the two-unit connecting heater 41, and it means that the two phases may be covered by one heater. Moreover, the two-unit connecting heater 41 serves as a current-carrying path. Since the R phase and the S phase are directly connected by the two-unit connecting heater 41, the two-unit connecting heater 41 has no terminals on the load side. Referring to FIG. 26, it is depicted that the trip portion assembly 40 has a load terminal 55 only at the T phase but no load terminals at the R and S phases.

Figure 27:
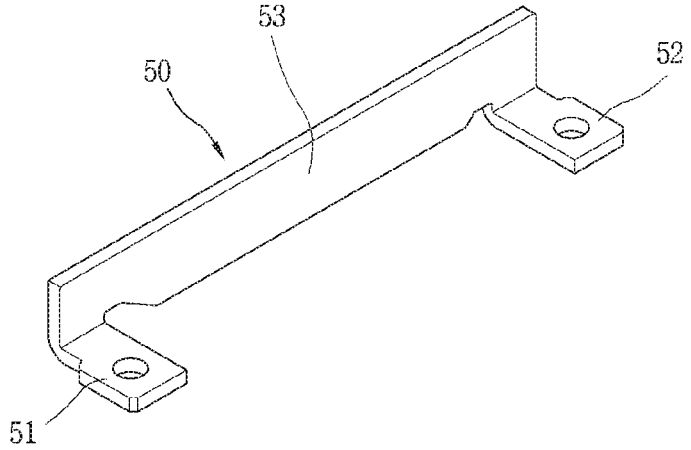
FIGS. 27 and 28 are perspective views of a connecting conductor and a two-phase connecting heater and trip portion that are applied to a three-unit molded case circuit breaker for DC according to an embodiment of the present invention.

Referring further to FIG. 27, a connecting conductor 50 is provided to connect the rear terminal (R phase terminal in this embodiment) at one of the two phases to a front terminal receiving portion. The connecting conductor 50 may include a first terminal 51 attached to the R phase terminal 36*b*, a second terminal 52 mounted in the R phase front terminal receiving portion 12, and a connecting portion 53 connecting the first terminal 51 and the second terminal 52. In this case, the first terminal 51 and the second terminal 52 are formed in parallel with the R phase terminal 36*b*, and the connecting portion 53 is formed perpendicular to the first terminal 51 and the second terminal 52. Accordingly, the expanded volume of the second protrusion 22 may be reduced to a minimum, thereby allowing for a compact circuit breaker design.

Although not listed and depicted separately herein, the connecting conductor 50 may exist in various embodiments. The connecting conductor 50 may be formed in various shapes and placed at appropriate positions within a range in which it comes with a compact design to be contained in the DC circuit breaker 10. For example, the connecting conductor 50 may be placed in a slot formed at the bottom of the case 11A.

The first terminal 51 is attached with a screw to the R phase terminal 36*b*. The second terminal 52 is inserted and mounted into the R phase front terminal receiving portion 12 through the insertion slot 17 on the sidewall 14 of the case 11A. The second terminal 52 serves as the R phase front terminal (load terminal). The connecting portion 53 is received in the first receiving slot 16 of the first protrusion 15 and the second receiving slot 23 of the second protrusion 22.

Since the connecting conductor 50 is contained and mounted within the outer casing, i.e., the case 11A and the cover 18A, of the DC circuit breaker 10, it is not exposed to the outside, thereby improving insulation performance. Moreover, the presence of the connecting conductor 50 allows for configuring the power source terminals and the load terminals on the front and rear of the DC circuit breaker, respectively, thus making it easy to recognize and use them. That is, a power source connecting terminal portion and a load connecting terminal portion are clearly and distinctively recognizable, and it is easy to connect a load without having to add an externally connected conductor, thereby improving assemblability.

Meanwhile, due to the presence of the two-unit connecting heater 41, an externally connected conductor for connecting load terminals of the R and S phases is unnecessary, and the number of components exposed out of the front terminal receiving portions 12 is reduced. This contributes to improvement in insulation performance.

Figure 20:
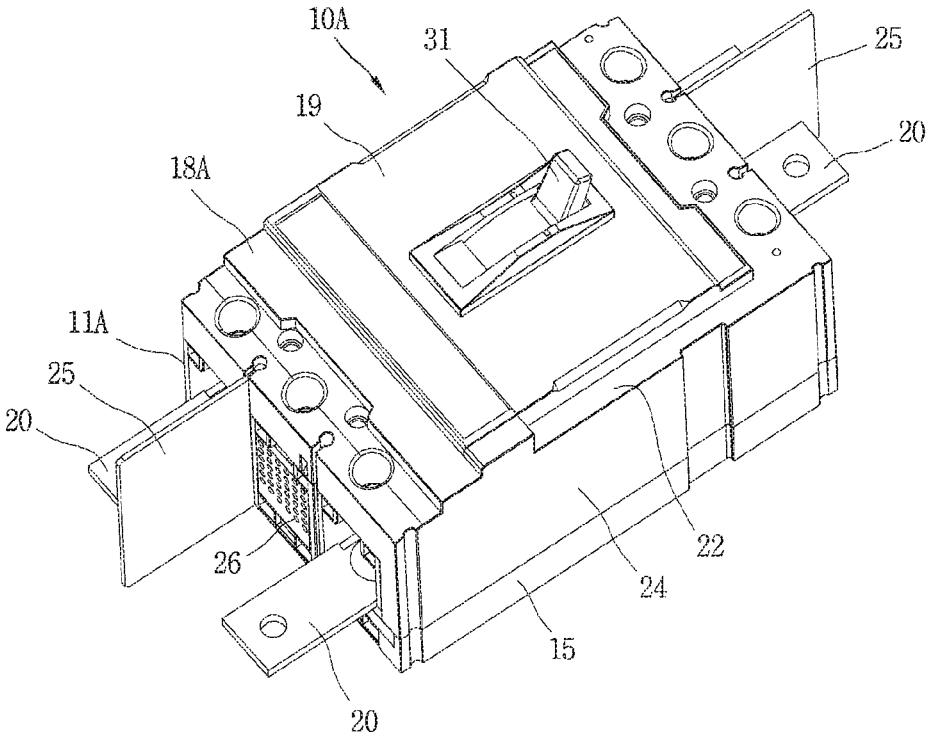
FIG. 20 is a perspective view of a three-unit molded-case circuit breaker for DC according to an embodiment of the present invention.

Referring to FIG. 20, an externally connected conductor 20 may be attached to terminals connected to a power source (the S phase- and T phase rear terminals 36*c* and 36*d* in this embodiment) and terminals connected to a load (the T phase front terminal 55 and the second terminal 52 in this embodiment). The externally connected conductor 20 is exposed out of the rear terminal receiving portions 13 or the front terminal receiving portions 12, thus providing convenience to the user.

Figure 21:
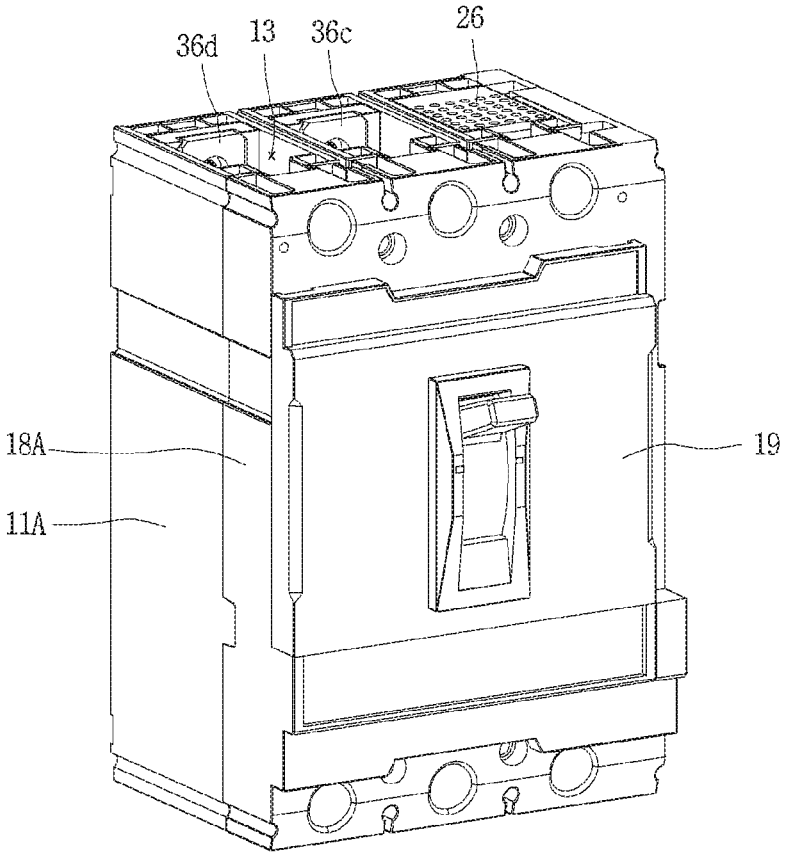
FIGS. 21 and 22 are perspective views of the DC circuit breaker of FIG. 12, from which the externally connected conductors and the insulation barriers are removed.
Figure 22:
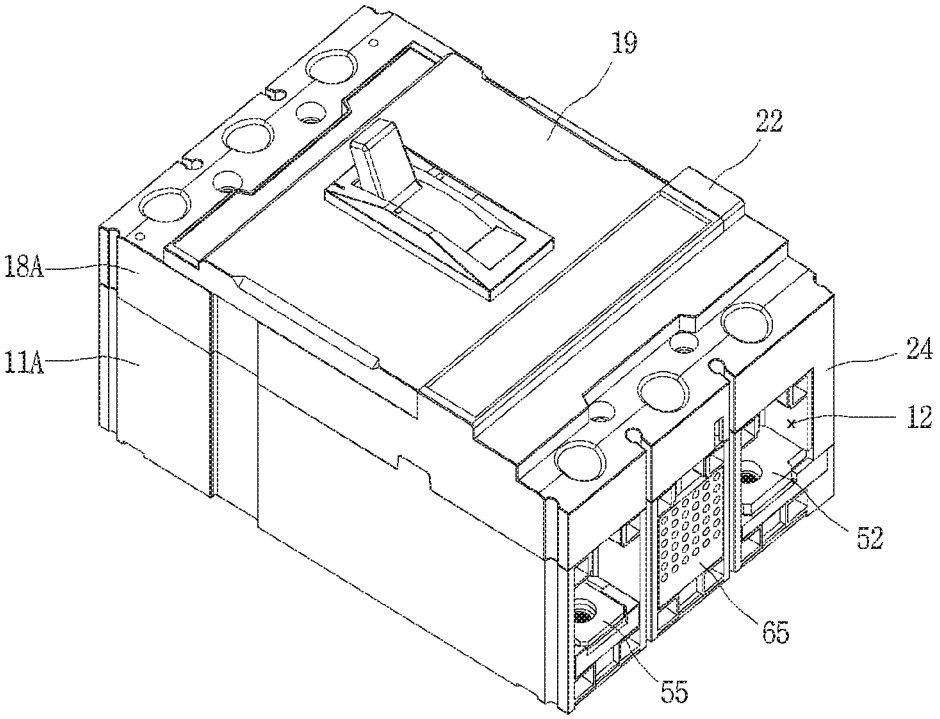
Figure 23:
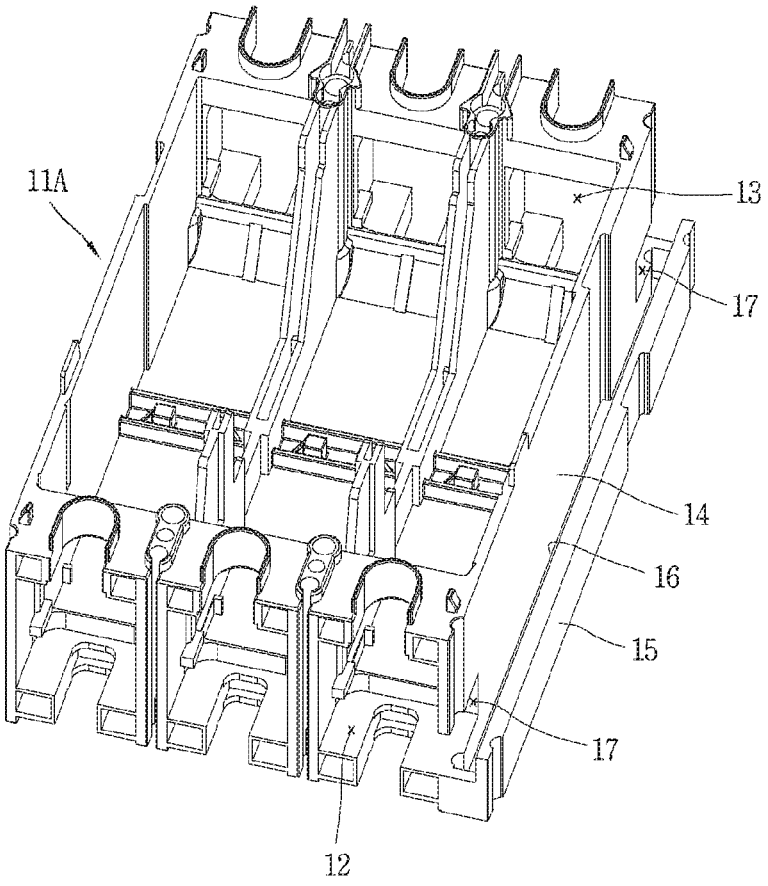
FIGS. 23 and 24 are perspective views of a case and a cover that are applied to a three-unit molded case circuit breaker for DC according to an embodiment of the present invention.
Figure 24:
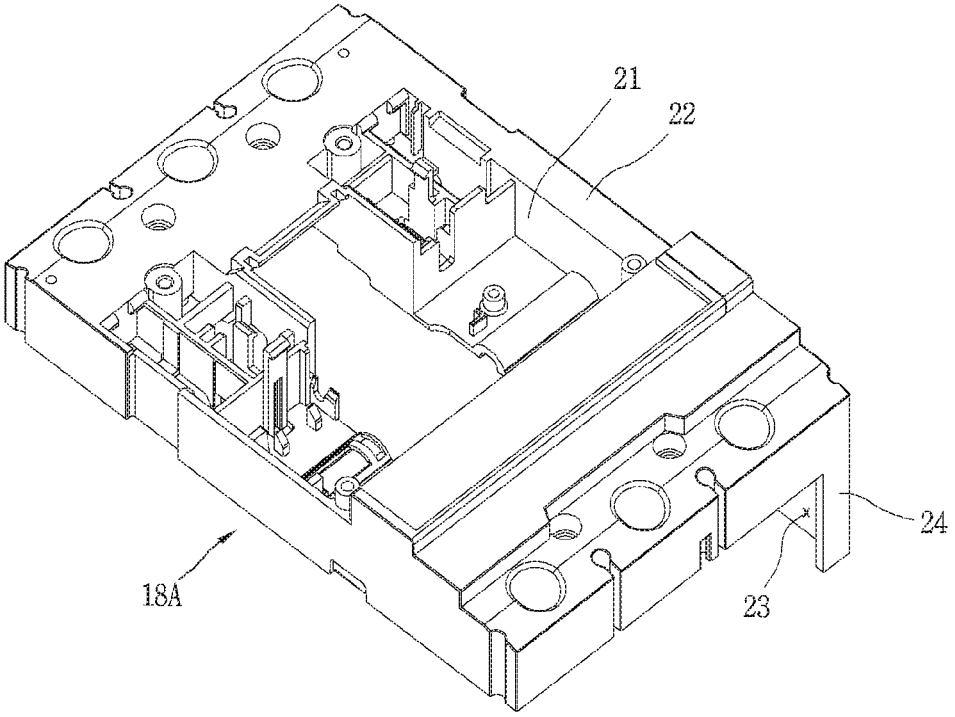

Referring to FIGS. 20 to 22, insulation covers 26 may be provided at the R phase rear terminal receiving portion 13 and S phase front terminal receiving portion 12 where no externally connected conductor 20 is provided. Because of the insulation covers 26 at the R phase rear terminal receiving portion 13 and S phase front terminal receiving portion 12, insulation performance is improved.

Moreover, an insulation barrier 25 may be provided between the R phase and the S phase, thereby ensuring the insulation between the phases.

Figure 29:
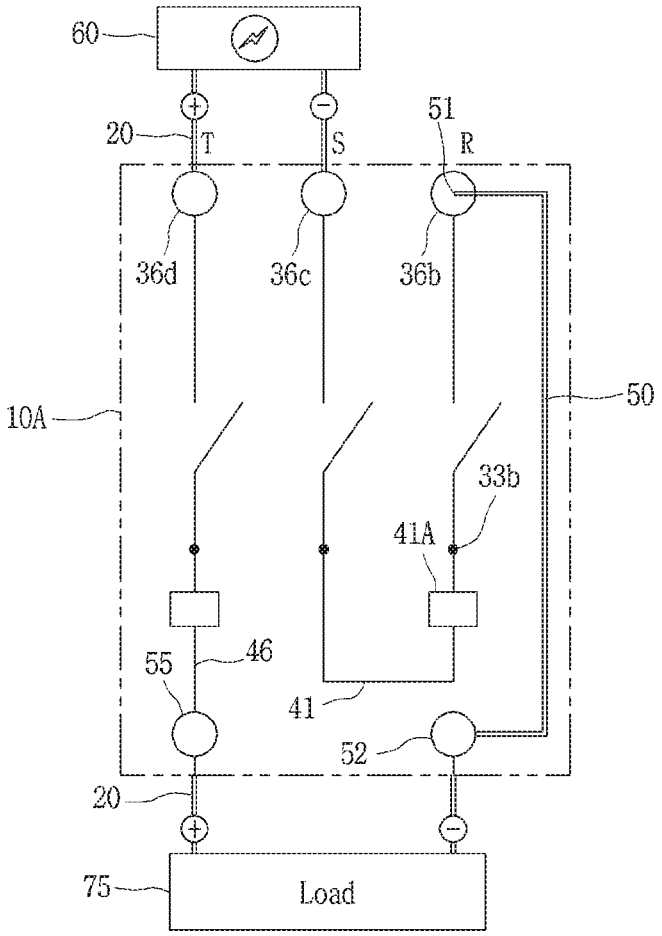
FIG. 29 is a wiring diagram of a three-unit molded case circuit breaker for DC according to an embodiment of the present invention.

Referring to FIG. 29, a wiring diagram of a three-unit molded case circuit breaker for DC according to an embodiment of the present invention will be described.

The power source 60 is connected to terminals on the rear of the DC circuit breaker 10A. The power source 60 is connected to the rear terminals of two phases (units) located on the other side of the DC circuit breaker 10A which are farthest from the phase (unit) where the connecting conductor 50 is provided.

In this embodiment, the plus pole of the power source 60 is connected to the T phase rear terminal 36*d*, and the minus pole of the power source 60 is connected to the S phase rear terminal 36*c*.

The load 70 is connected to front terminal (load terminal) on the front of the DC circuit breaker 10A. The load 70 is connected to the load terminals of two phases (units) located on both sides of the DC circuit breaker 10A. In this embodiment, the plus pole of the load 70 is connected to the T phase front terminal 55, and the minus pole of the load 70 is connected to the R phase front terminal, i.e., the second terminal 52 of the connecting conductor 50.

An externally connected conductor 20 may be provided at the terminals connected to the power source and load. The externally connected conductor 20 is for providing assemblability to the user and regulating the amount of current carried, and may be optionally used.

Since the connecting conductor 50 and the two-unit connecting heater 41 are contained in the DC circuit breaker 10, insulation performance is greatly improved. The tripping mechanism 41A (which collectively refers to 42, 46, 47, 48, and 49), except the heater, may be provided at one of the two phases connected to the two-unit connecting heater 41. That is, no tripping mechanism is provided at one of the R and S phases.

The R phase- and S phase terminals are eliminated from the front terminals (load terminals). The second terminal 52 of the connecting conductor 50 is substituted for the R phase terminal.

While this embodiment has been described with respect to a three-phase (three-unit) molded case circuit breaker for DC, it is needless to say that the present invention may be applied to a DC circuit breaker with an odd number of phases (units) more than or equal to three phases (units). In this case, it should be noted that the power source (or load) is connected to two adjacent rear terminals on one side, and the load (or power source) is connected to two front terminals on both sides (one of which that is located on the other side is the second terminal of the connecting conductor). For the other terminals, a two-unit connecting heater is used between adjacent terminals.

According to a molded-case circuit breaker for DC according to an embodiment of the present invention, the circuit breaker has a connecting conductor within it, the power source terminals and the load terminals are configured on the front and rear of the DC circuit breaker in an easily distinguishable manner. Thus, the user does not need to add more connecting conductors, and the assemblability of the power source and load is improved.

Moreover, external insulation breakdown is prevented since the connecting conductor is configured within the outer casing. In addition, part of the terminal portion is eliminated, thus enhancing insulation from the outside.

Further, unlike the heater provided at the T phase, a U-shaped, two-unit connecting heater is provided at the R phase and the S phase to directly connect them, and therefore the number of tripping mechanisms can be reduced, thus leading to a reduction in parts and production cost.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A molded-case circuit breaker for DC that contains a plurality of interruption units within an outer casing, the DC circuit breaker comprising a two-unit connecting heater that connects fixed contacts of adjacent interruption units, the two-unit connecting heater being placed within the outer casing, wherein the adjacent interruption units are connected to each other as a series circuit, wherein the two-unit connecting heater is formed in a U-shape, and comprises:

a pair of head portions respectively connected to the fixed contacts of the adjacent interruption units;

a pair of body portions extending downward from the head portions; and a leg portion connecting the pair of body portions, and wherein one of the pair of body portions has a tripping mechanism that detects an over-current in a circuit and interrupts the circuit, wherein a trip portion case for receiving the two-unit connecting heater and the tripping mechanism is placed within the outer casing, and wherein the trip portion case has a partition for insulation between the interruption units, and a cut groove is formed on a part of the partition to insert the leg portion.

2. The circuit breaker of claim 1, wherein the head portions and the leg portion are horizontal planes, and the body portions are vertical planes.

3. The circuit breaker of claim 1, wherein front terminal receiving portions and rear terminal receiving portions are provided on the front and rear of the outer casing, and insulation covers are provided to close the front terminal receiving portions or the rear terminal receiving portions.

4. The circuit breaker of claim 1, wherein a trip portion insulation cover is provided on the front of the trip portion case.

5. The circuit breaker of claim 4, wherein assembly holes are formed in the leg portion so as to couple with the trip portion case.

6. The circuit breaker of claim 1, further comprising a connecting conductor, one end of which is connected to a rear terminal of an interruption unit on one side, and an other end of which is mounted in a front terminal receiving portion of the interruption unit on one side, with the connecting conductor being mounted within the outer casing.

7. The circuit breaker of claim 6, wherein the connecting conductor comprises:

a first terminal attached to the rear terminal of the interruption unit on one side;

a second terminal mounted in the front terminal receiving portion of the interruption unit on one side; and a connecting portion connecting the first terminal and the second terminal.

8. The circuit breaker of claim 6, wherein the outer casing comprises:

a box-shaped case with a top and part of the front and rear being open; and a cover attached to the top of the case, wherein the case has a first protrusion protruding from a bottom of one sidewall, the first protrusion has a first receiving slot formed along the length, the cover has a second protrusion protruding out from one sidewall, and the second protrusion has a second receiving slot formed along a length to communicate with the first receiving slot, with the connecting conductor being inserted into the first and second receiving slots.

9. The circuit breaker of claim 8, wherein an extension extends downward along an outer wall of the second protrusion, and the extension has such a length at which it can adjoin the first protrusion.

10. The circuit breaker of claim 8, wherein the second protrusion has the same width as the first protrusion.

11. The circuit breaker of claim 8, wherein a cut groove is formed on one sidewall of the case to insert part of the connecting conductor.

* * * * *